US007138993B2

(12) United States Patent
Herrmann

(10) Patent No.: US 7,138,993 B2
(45) Date of Patent: Nov. 21, 2006

(54) LCD WITH INTEGRATED SWITCHES FOR DC RESTORE

(75) Inventor: Frederick P. Herrmann, Sharon, MA (US)

(73) Assignee: Kopin Corporation, Taunton, MA (US)

( * ) Notice: Subject to any disclaimer, the term of this patent is extended or adjusted under 35 U.S.C. 154(b) by 350 days.

(21) Appl. No.: 10/370,038

(22) Filed: Feb. 19, 2003

(65) Prior Publication Data

US 2003/0174113 A1 Sep. 18, 2003

Related U.S. Application Data

(60) Provisional application No. 60/357,944, filed on Feb. 19, 2002.

(51) Int. Cl.
*G09G 5/00* (2006.01)

(52) U.S. Cl. ..... 345/211; 345/205

(58) Field of Classification Search ..... 345/204–215, 345/690, 50, 52, 53, 209, 96
See application file for complete search history.

(56) References Cited

U.S. PATENT DOCUMENTS

| | | | | |
|---|---|---|---|---|
| 3,555,175 | A * | 1/1971 | Griepentrog | 348/692 |
| 4,549,215 | A * | 10/1985 | Levine | 348/257 |
| 4,804,903 | A | 2/1989 | Yundt | |
| 5,140,422 | A * | 8/1992 | Constable | 348/525 |
| 5,526,058 | A * | 6/1996 | Sano et al. | 348/647 |
| 6,040,815 | A | 3/2000 | Erhart et al. | |
| 6,097,352 | A | 8/2000 | Zavracky et al. | |
| 6,121,950 | A | 9/2000 | Zavracky et al. | |
| 6,201,522 | B1 | 3/2001 | Erhart et al. | |
| 6,256,076 | B1 | 7/2001 | Bae et al. | |
| 6,295,043 | B1 | 9/2001 | Hashimoto et al. | |
| 6,304,304 | B1 | 10/2001 | Koma | |
| 6,320,566 | B1 | 11/2001 | Go | |
| 6,323,847 | B1 * | 11/2001 | Kaneko et al. | 345/204 |
| 6,342,876 | B1 | 1/2002 | Kim | |
| 6,509,894 | B1 * | 1/2003 | Maekawa et al. | 345/211 |

FOREIGN PATENT DOCUMENTS

| | | |
|---|---|---|
| GB | 2163327 A | 2/1986 |
| JP | 09083837 | 3/1997 |
| JP | 10214066 | 8/1998 |
| JP | 2000347159 | 12/2000 |
| WO | WO 01/91427 A2 | 11/2001 |

OTHER PUBLICATIONS

XRD9815, "3-Channel 12-Bit Linear CCD & CIS Sensor Signal Processors," (EXAR) May 2000.
"Video Amplifier with Sync Stripper and DC Restore (HFA1103)," (Intersil) Jun. 1995.
http:www.google.com/search?q=cache:Y0pURNOzbSIC.www.cfht.hawaii.edu/scug/psf... pp. 1-9, Mar. 6, 2002.

* cited by examiner

*Primary Examiner*—Bipin Shalwala
*Assistant Examiner*—Steven Holton
(74) *Attorney, Agent, or Firm*—Hamilton, Brook, Smith & Reynolds, P.C.

(57) ABSTRACT

An AC-coupled display driver circuit includes one or more DC-restore switches that are integrated within a liquid crystal display. A liquid crystal display system includes a coupling capacitor coupled at one end to a system input video signal, the coupling capacitor providing a display input video signal having a DC level offset. A liquid crystal display device coupled to another end of the coupling capacitor receives the first display input video signal at a video input for driving the display device. A switch integrated within the display device provides DC restore to the coupling capacitor.

18 Claims, 29 Drawing Sheets

VSS < VCOM < VIDH < VDD

CONTROL SIGNALS U*, S*,P ALL SWING VSS – VDD

VSS < VCOM < VDD
VSS < VID < VDD
VID SWINGS ABOVE AND BELOW VCOM

LCD WITH INTEGRATED SWITCHES FOR DC RESTORE

RELATED APPLICATION

This application claims the benefit of U.S. Provisional Application No. 60/357,944, filed Feb. 19, 2002. The entire teachings of the above application are incorporated herein by reference.

BACKGROUND

Generally, liquid crystal displays (LCDs) do not work well with direct current (DC) voltages. A graph of transmission versus voltage of an LCD is shown in FIG. 1, showing high transmission with zero voltage and low transmission with either positive or negative voltage. To drive the LCD to black, a positive voltage cannot be placed on the LCD. A steady state DC voltage may damage the display by, for example, causing contaminants to plate one side or the other of the liquid crystal cell. To preserve zero (0) DC (DC restore) and prevent damage, generally the voltage applied to the LCD is flipped back and forth (alternated) between high-black, low-black, high-black, low-black.

There are different scenarios for preserving zero (0) DC, as shown in the series of succeeding frames of FIGS. 2A–2D. One scenario uses column inversion as shown in FIG. 2A, where one frame is written with all the columns having alternating polarity, positive-negative, positive-negative. In the next frame all the columns are written negative-positive, negative-positive. In the succeeding frame, all the columns are again written positive-negative, positive-negative. As shown in FIG. 2B, frame inversion can be used where the first frame is written with all positives and the next frame is written with all negatives. The succeeding frame is again written with all positives. As shown in FIG. 2C, pixel inversion can be used which produces a checkerboard like effect in the first frame and an inverted effect in the second frame. In the third frame, the checkerboard like effect matches that of the first frame. Lastly, as shown in FIG. 2D, row inversion can be used where all the rows are alternating polarity, positive-negative, positive-negative. In the next frame all the rows are written negative-positive, negative-positive. In the third frame, the rows are again written positive-negative, negative-negative.

SUMMARY

Suitable DC-coupled display driver circuits require high supply voltages. Some AC-coupled display driver approaches have an advantage of being able to use lower voltage amplifiers. However, external switches required for DC restore in such systems still must handle higher voltages. Thus, there is a need for improvement in display systems that avoids both additional higher voltage processes and increased parts count.

The present invention provides a more desirable approach for AC-coupled display driver circuitry. For embodiments in accordance with the present approach, one or more DC-restore switches are integrated within a liquid crystal display. In this manner, the integrated switches can be implemented in the same high-voltage process used for the display's internal circuits. An advantage is that no external integrated circuit is needed for the DC-restore switches, and system input amplifiers can be integrated with other components on a low-voltage integrated circuit.

Accordingly, a liquid crystal display system includes a coupling capacitor coupled at one end to a system input video signal, the coupling capacitor providing a display input video signal having a DC level offset. A liquid crystal display device coupled to another end of the coupling capacitor receives the first display input video signal at a video input for driving the display device. A switch integrated within the display device provides DC restore to the coupling capacitor.

In another embodiment, a second coupling capacitor coupled at one end to the system input video signal provides a second display input video signal having a second DC level offset. The liquid crystal display device includes a second video input coupled to another end of the second coupling capacitor to receive the second display input video signal for driving the display device. A second switch integrated within the display device provides DC restore to the second coupling capacitor.

The integrated switches are operable to provide DC restore to the coupling capacitors when operated during a retrace interval of the system input video signal.

According to another aspect, a liquid crystal display system features a single system input video signal. An amplifier having switchable gain polarity coupled to the system input video signal provides an amplified system input video signal. A first coupling capacitor coupled at one end to the amplifier provides a first display input video signal having a first DC level offset. A second coupling capacitor coupled at one end to the amplifier provides a second display input video signal having a second DC level offset. A liquid crystal display device receives the first and second display input video signals for driving the display device. First and second switches provide DC restore to the first and second coupling capacitors, respectively. The first and second switches may be external to the display device or integrated into the display device.

BRIEF DESCRIPTION OF THE DRAWINGS

The foregoing and other objects, features and advantages of the invention will be apparent from the following more particular description of preferred embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Figure 1:
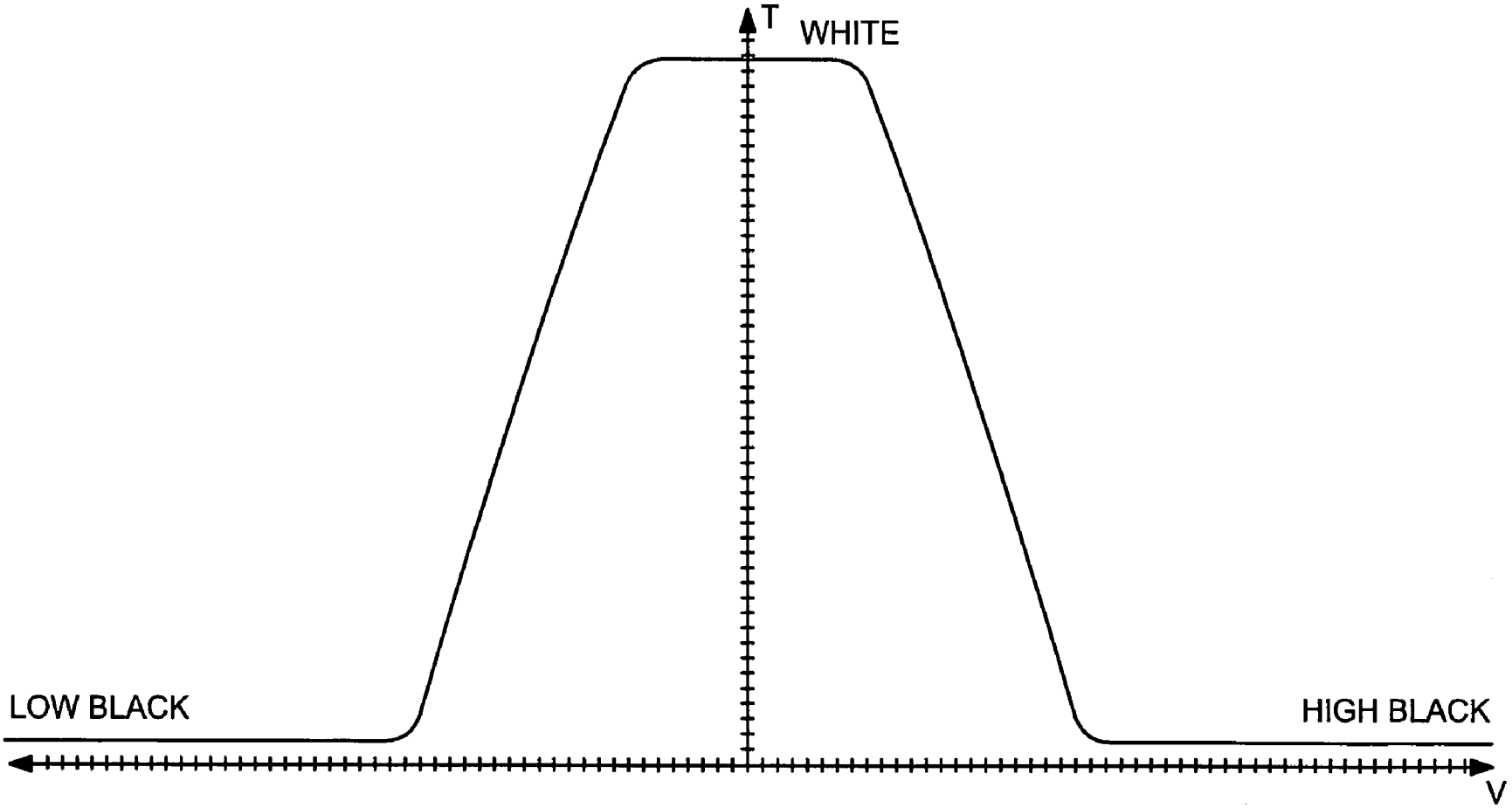
FIG. 1 PRIOR ART
FIG. 1 is a transmission versus voltage diagram.
Figure 2A:
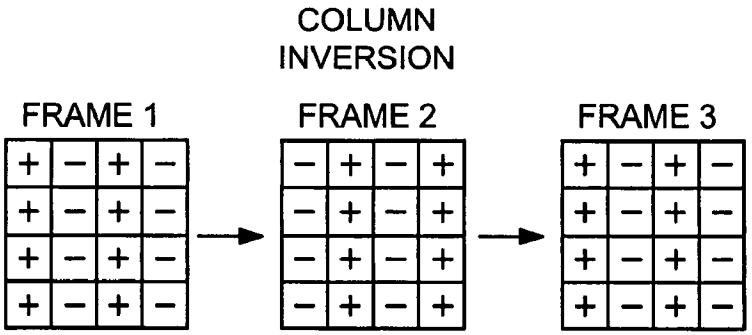
FIG. 2A PRIOR ART
FIGS. 2A–2D are diagrams showing successive frames using column inversion, frame inversion, pixel inversion and row inversion, respectively.
Figure 2B:
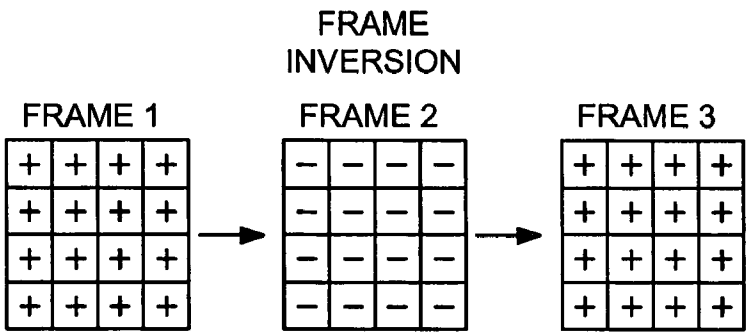
FIG. 2B PRIOR ART
Figure 2C:
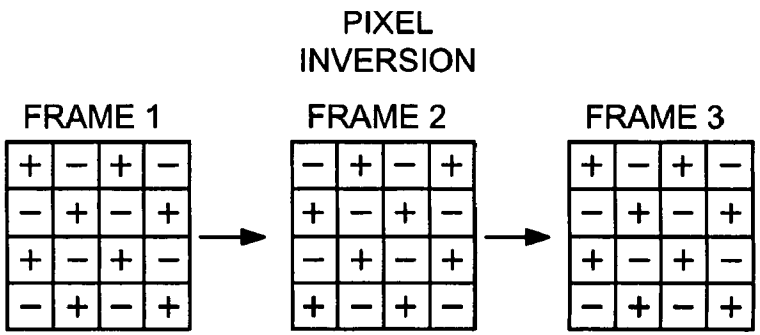
FIG. 2C PRIOR ART
Figure 2D:
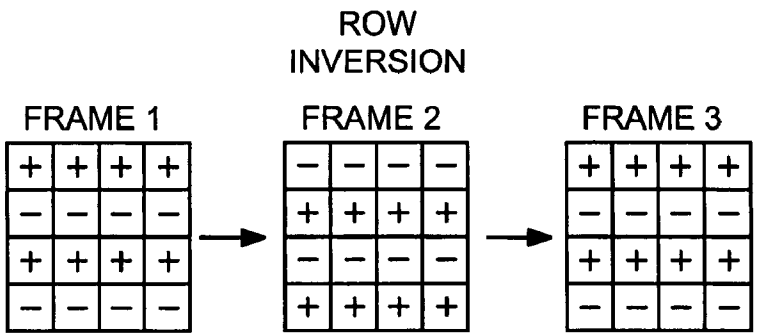
FIG. 2D PRIOR ART
Figure 3A:
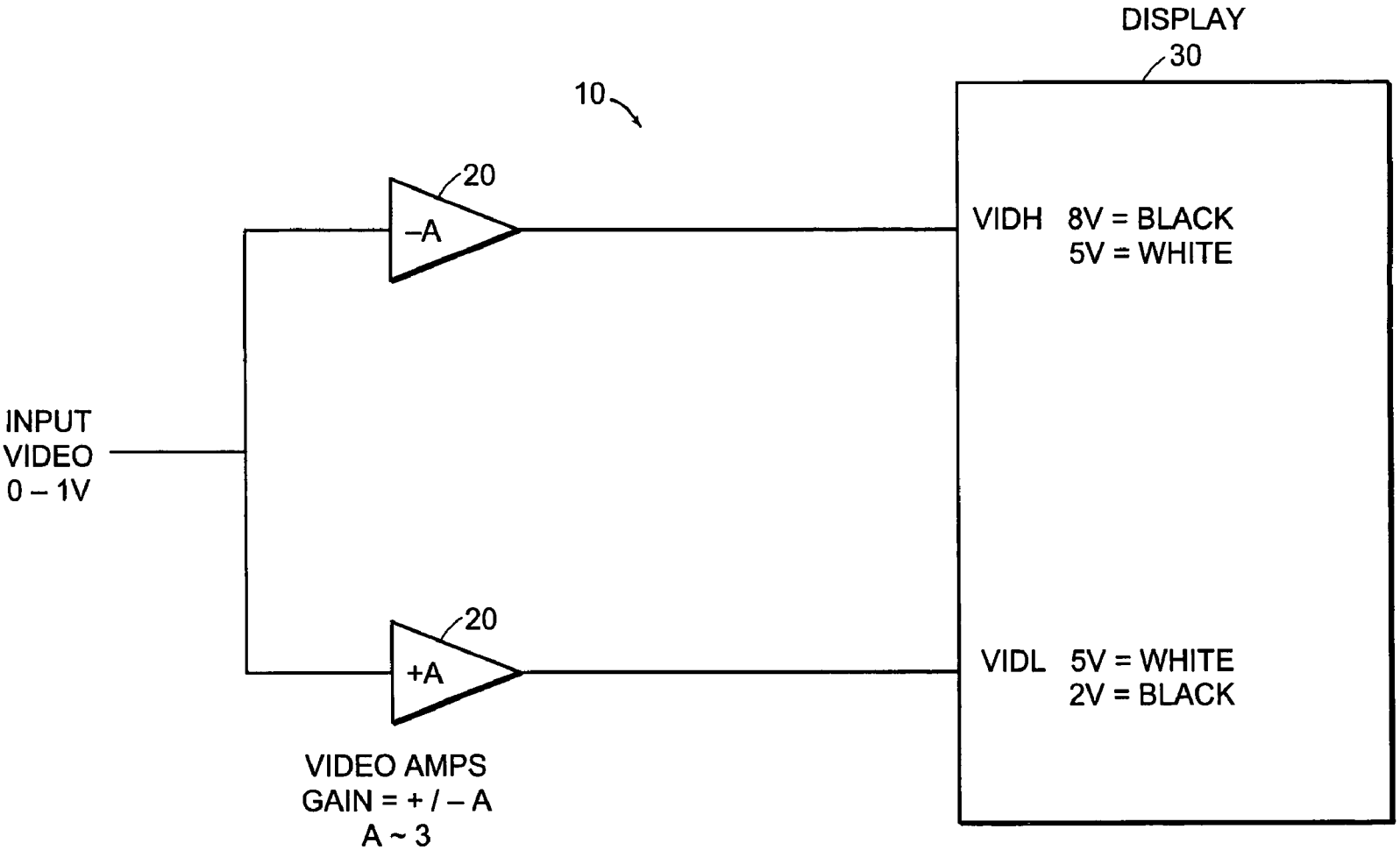
FIG. 3A PRIOR ART
FIG. 3A is a schematic circuit diagram of a DC-coupled driver circuit with two amplifiers.
Figure 3B:
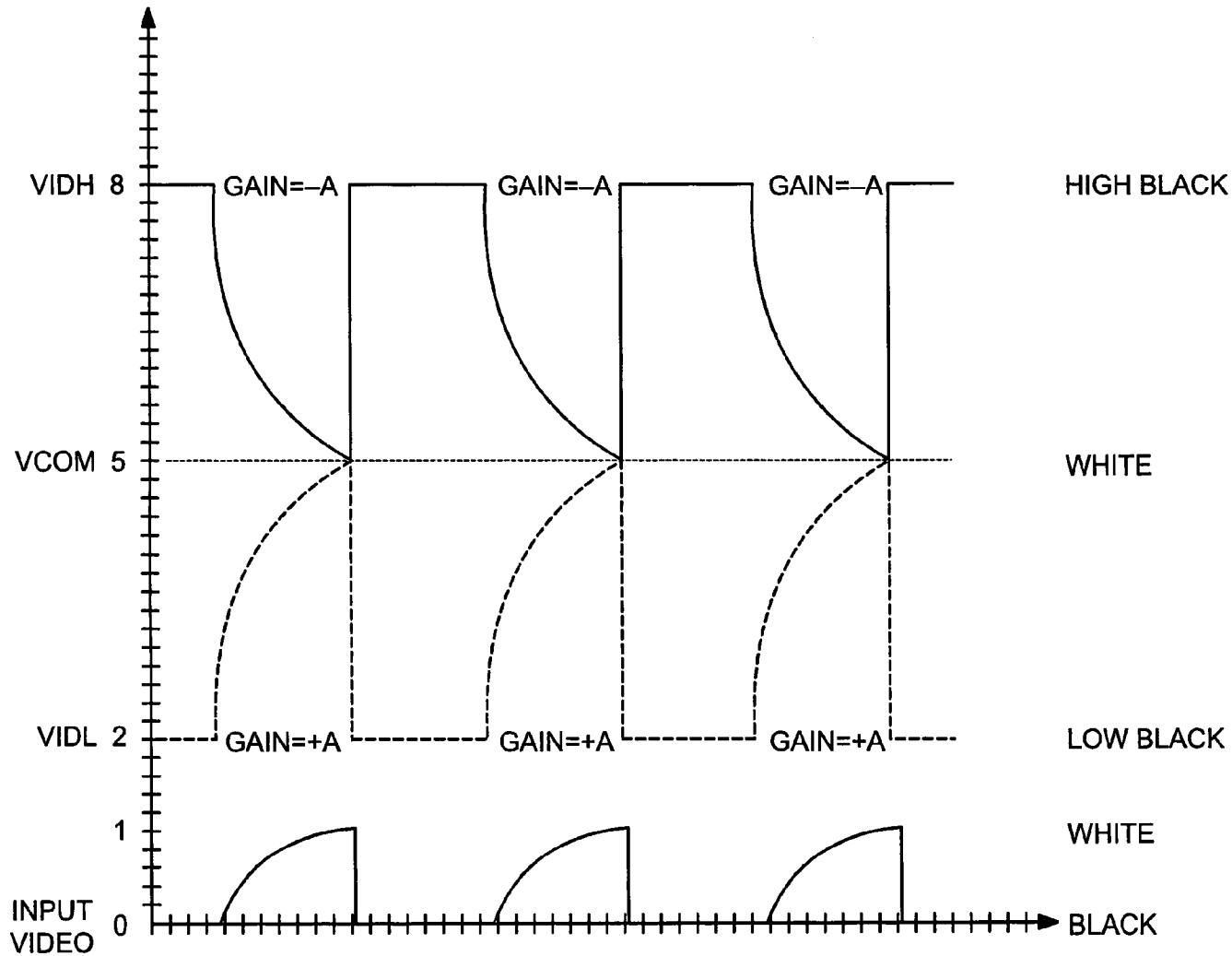
FIG. 3B PRIOR ART
FIG. 3B is a waveform diagram for signals applied in the circuit of FIG. 3A.

FIG. 3A shows a DC-coupled driver circuit 10 with two video signals, video high (VIDH) and video low (VIDL), coupled to a liquid crystal display device 30. Generally, the signals VIDH and VIDL are complementary signals that drive an active matrix of pixel elements not shown for clarity. To alleviate the use of negative voltages, the signals are centered around 5 volts, which is the voltage applied to the common electrode (VCOM) of all pixels. Thus, 5 volts applied to the VIDH signal puts 0 volts across the pixel, driving it to the white state. When VIDH is 8 volts, the pixel voltage is +3 volts (black). VIDL ranges from 5 volts white to 2 volts black. The input video signal swing is typically 1 volt, therefore positive and negative amplifiers 20 are needed with matching gains of +3 and −3 volts. FIG. 3B is a waveform diagram of video signals applied in the circuit 10 of FIG. 3A using row inversion.

The system just discussed, with separate VIDH and VIDL signals (FIG. 3A), is well-suited for use with column and pixel inversion, because every row of the display contains pixels of both positive and negative polarity. (A representative display is disclosed in U.S. Pat. No. 6,476,784, which is incorporated herein by reference in its entirety.) Therefore, both amplifiers are in nearly continuous use. However, when row inversion or frame inversion drive is used, then all pixels of a given row are the same polarity, and the VIDH and VIDL signals cannot be used at the same time. One of the two amplifiers (+A or −A) will always be idle.

Figure 4A:
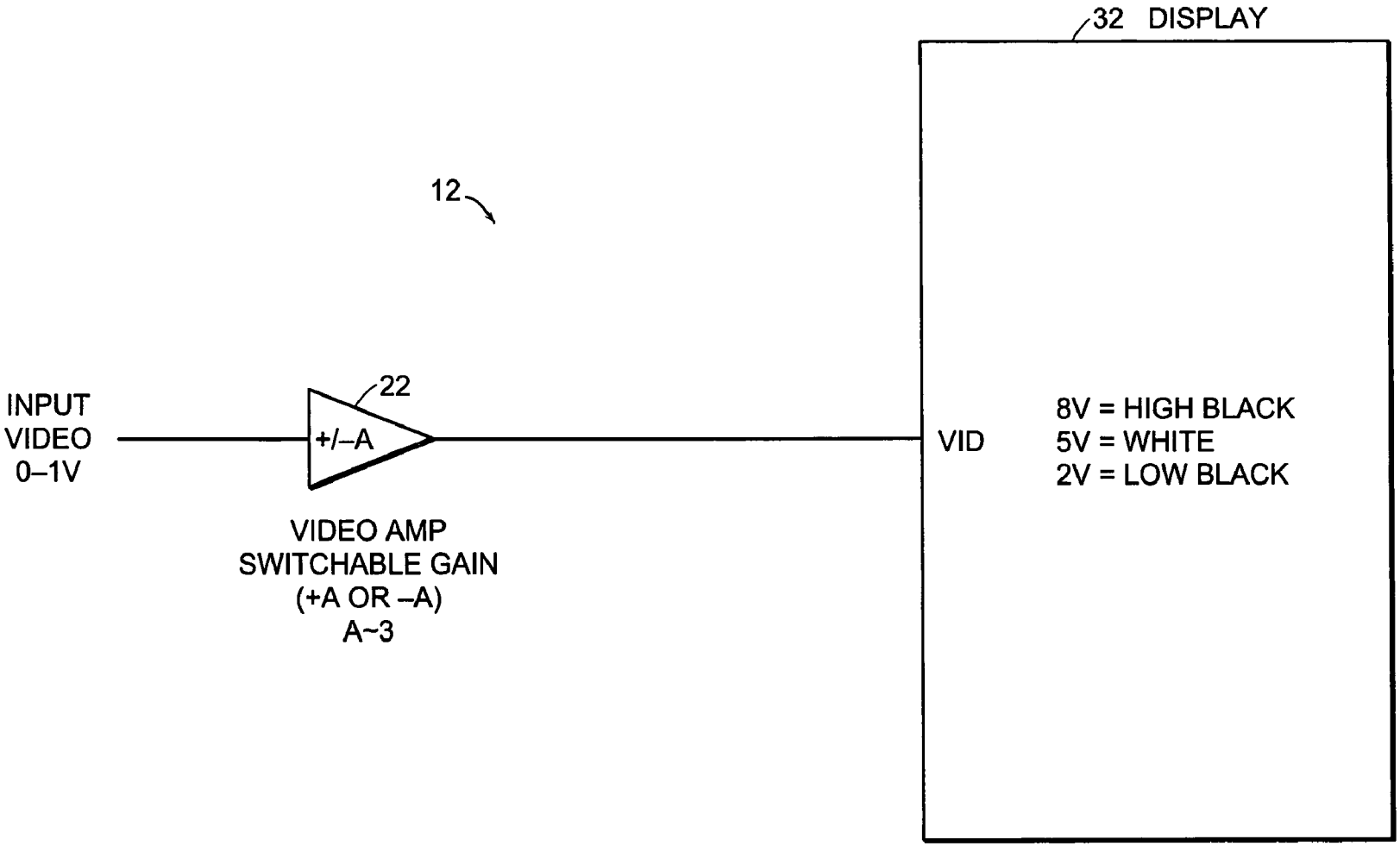
FIG. 4A PRIOR ART
FIG. 4A is a schematic circuit diagram of a DC-coupled driver circuit with a single amplifier having switchable gain polarity.
Figure 4B:
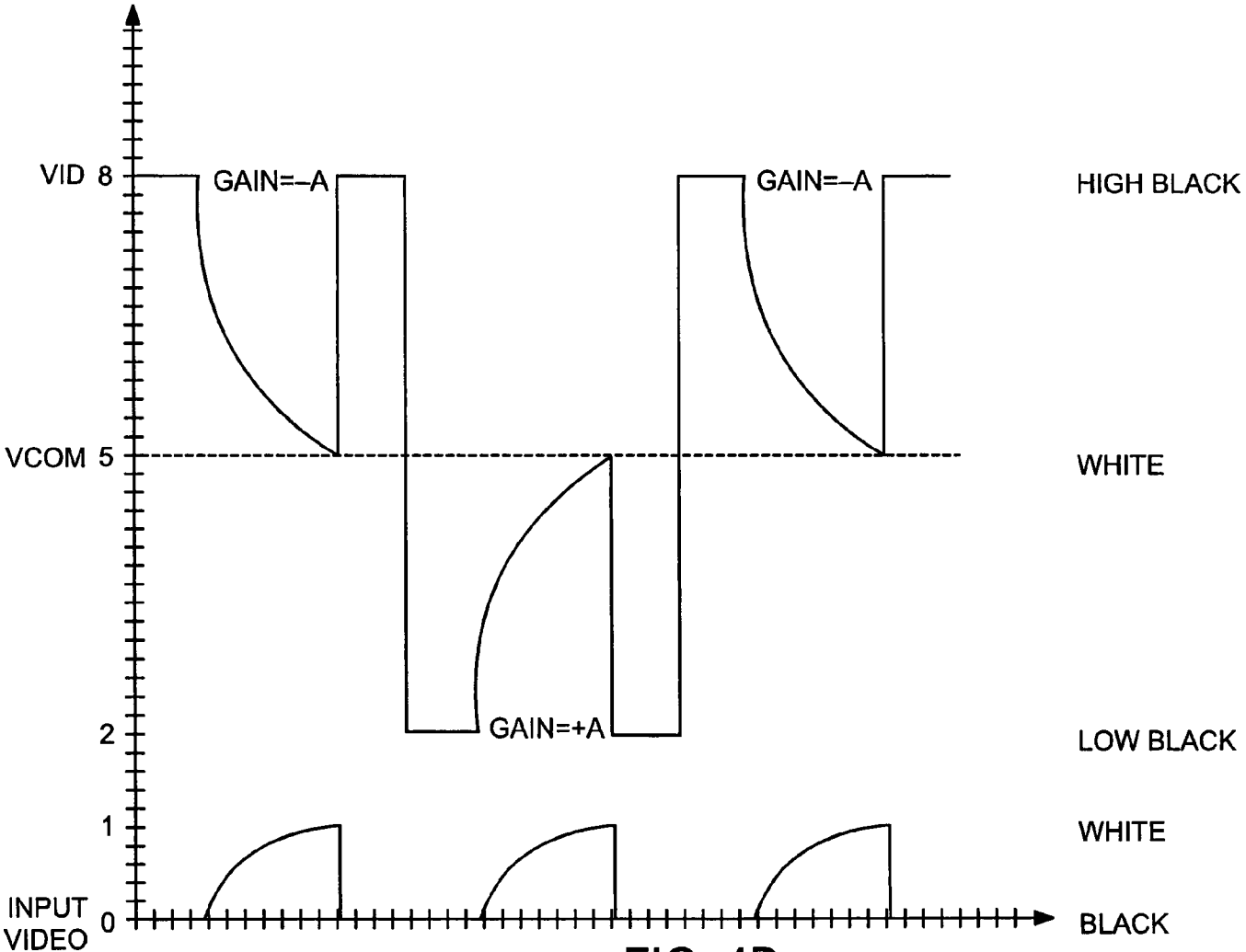
FIG. 4B PRIOR ART
FIG. 4B is a waveform diagram for signals applied in the circuit of FIG. 4A.

To avoid underutilized amplifiers in the situation just described, row inversion displays typically use a driver circuit such as that shown in FIG. 4A. In the circuit 12, a single video signal (VID) is driven by a single amplifier 22 coupled to display 32. The amplifier polarity is switched for positive or negative gain. When writing a row of positive pixels, VID swings from white to high black (as does VIDH in FIG. 3A). For a negative row, the opposite amplifier polarity is used so that VID swings from white to low black. The amplifier is fully utilized, but the VID signal swing (8−2=6V) is twice that of VIDH (8−5=3V) or VIDL (5−2=3V). FIG. 4B is a waveform diagram of video signals applied in the circuit of FIG. 4A using row inversion.

Figure 5:
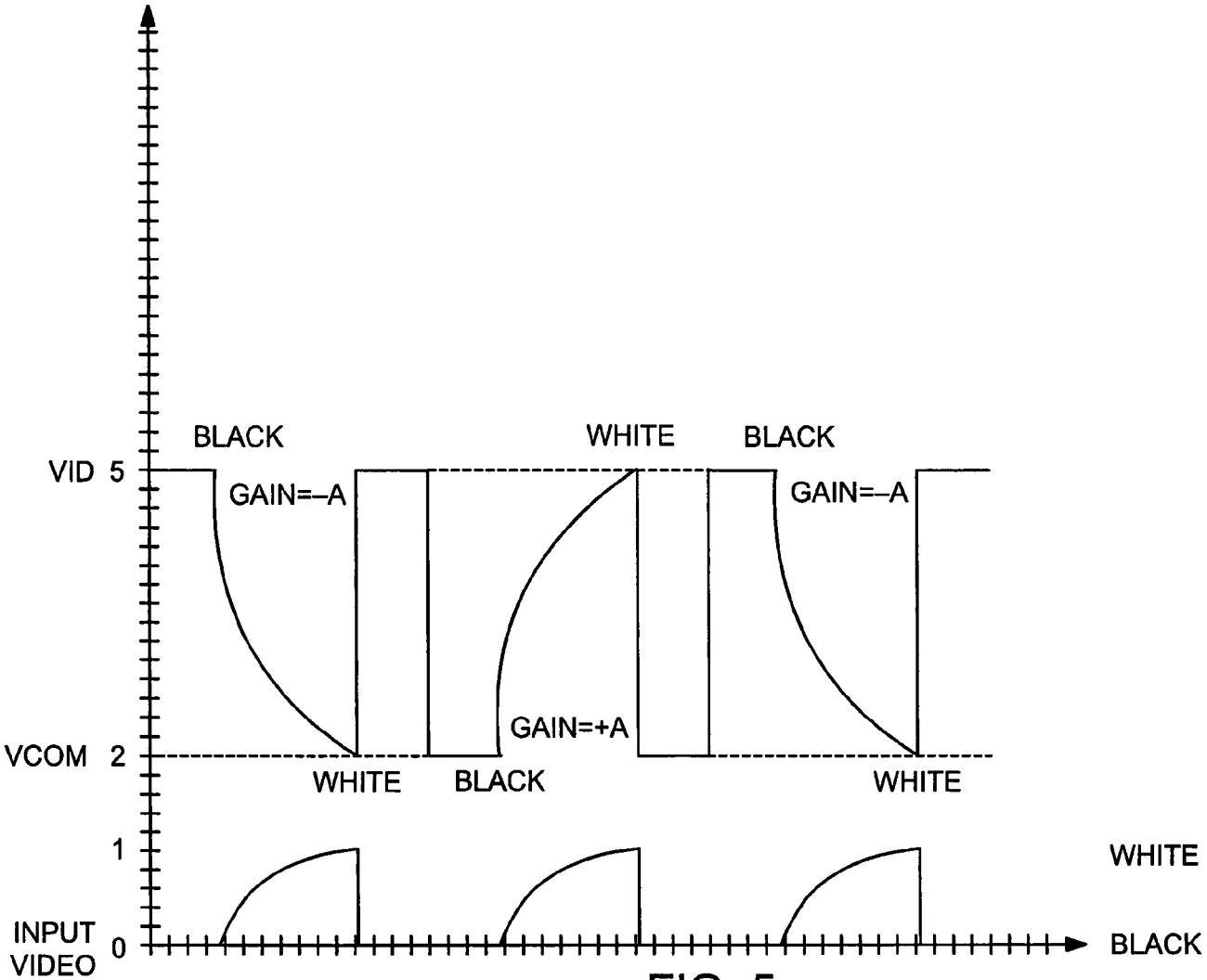
FIG. 5 PRIOR ART
FIG. 5 is a waveform diagram related to driving a common electrode with an AC signal.

One widely-used technique for reducing the VID signal swing is to drive the common electrode VCOM with an AC signal. This AC-common drive scheme is shown in the waveform diagram of FIG. 5. The VCOM level is reduced to 2 volts when writing positive rows, so that the +3V black level is written with VID at 5 volts. Negative rows drive VCOM to 5 volts, so that 3V black is written with VID at 2 volts. In both cases, the VID signal swing is only (5−2=3V). One disadvantage of AC-common drive is that it requires additional circuitry to switch the VCOM level. Another disadvantage is incompatibility with some pixel designs and scanner circuits.

In some cases, the required video bandwidth may be greater than can be practically supplied on a single VID signal or pair of VIDH and VIDL signals. Examples include higher resolution displays with a large number (>~300 k) pixels, and displays intended to operate at unusually high frame rates (>~60 Hz). These displays may use multiple VID inputs or pairs of VIDH and VIDL inputs to achieve the necessary bandwidth. Color displays may also use multiple video inputs for separate red, green, and blue component signals. For clarity, the following discussion continues to refer to single inputs or input pairs, but the ideas and techniques described may be readily scaled for displays with multiple inputs.

A disadvantage of the DC-coupled systems is their high supply voltage. If VCOM is held at a DC level, then at least one amplifier will require a supply exceeding the high black level of 8 volts. Even with AC-common drive, the maximum video voltage level of 5 volts is significantly greater than the actual 3-volt swing, because of the 2-volt minimum level imposed by the display's circuits. The high supply voltages increase the system power dissipation, and also limit the technologies available for implementing the video amplifiers. For example, an 8-volt video amplifier may require a relatively expensive BiCMOS process. A 5-volt amplifier may be implemented in a specialized analog CMOS process. A more desirable solution would be a rail-to-rail amplifier driving 3-volt video with a 3.3-volt supply and implemented in a conventional CMOS logic process. Such CMOS processes are widely available and relatively inexpensive. Moreover, the 3.3-volt CMOS solution may lead to higher integration, since the amplifier may be integrated on the same chip as other system components.

Figure 6A:
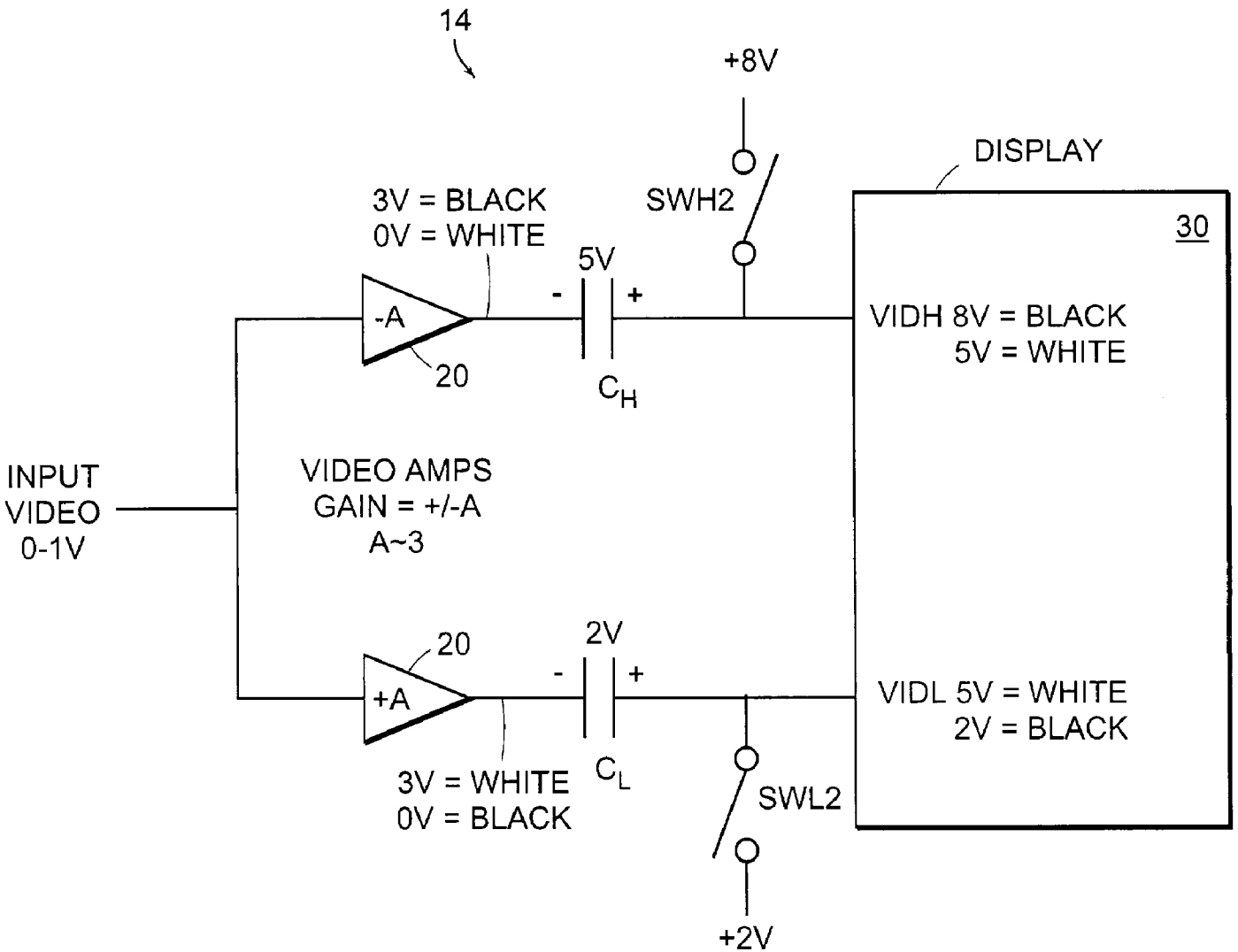
FIG. 6A is a schematic circuit diagram of an AC-coupled driver circuit with two amplifiers, configured for resetting the display to black.

FIG. 6A shows a circuit 14 with low-voltage amplifiers 20 and AC-coupled drive for column inversion. Capacitors $C_H$ and $C_L$ are used to shift the DC level. The outputs of both amplifier swing 0–3 volts on the left side of the capacitors, but on the right side of the capacitors the display 30 sees 5–8 volts on VIDH and 2–5 volts on VIDL. For proper operation, the voltage offsets across $C_H$ and $C_L$ must be maintained at +5 and +2 volts, respectively. These offsets are periodically refreshed by driving the input video to black and closing DC-restore switches SWH2, SWL2. Upon operation of the switches SWH2, SWL2, the left plate of $C_H$ will be at +3V and the right plate at +8V, resulting in the desired +5V offset. Similarly, capacitor $C_L$ will be restored to a 2-volt offset. This refresh may be performed during the horizontal retrace time between rows, so it does not interfere with display operation.

Figure 6B:
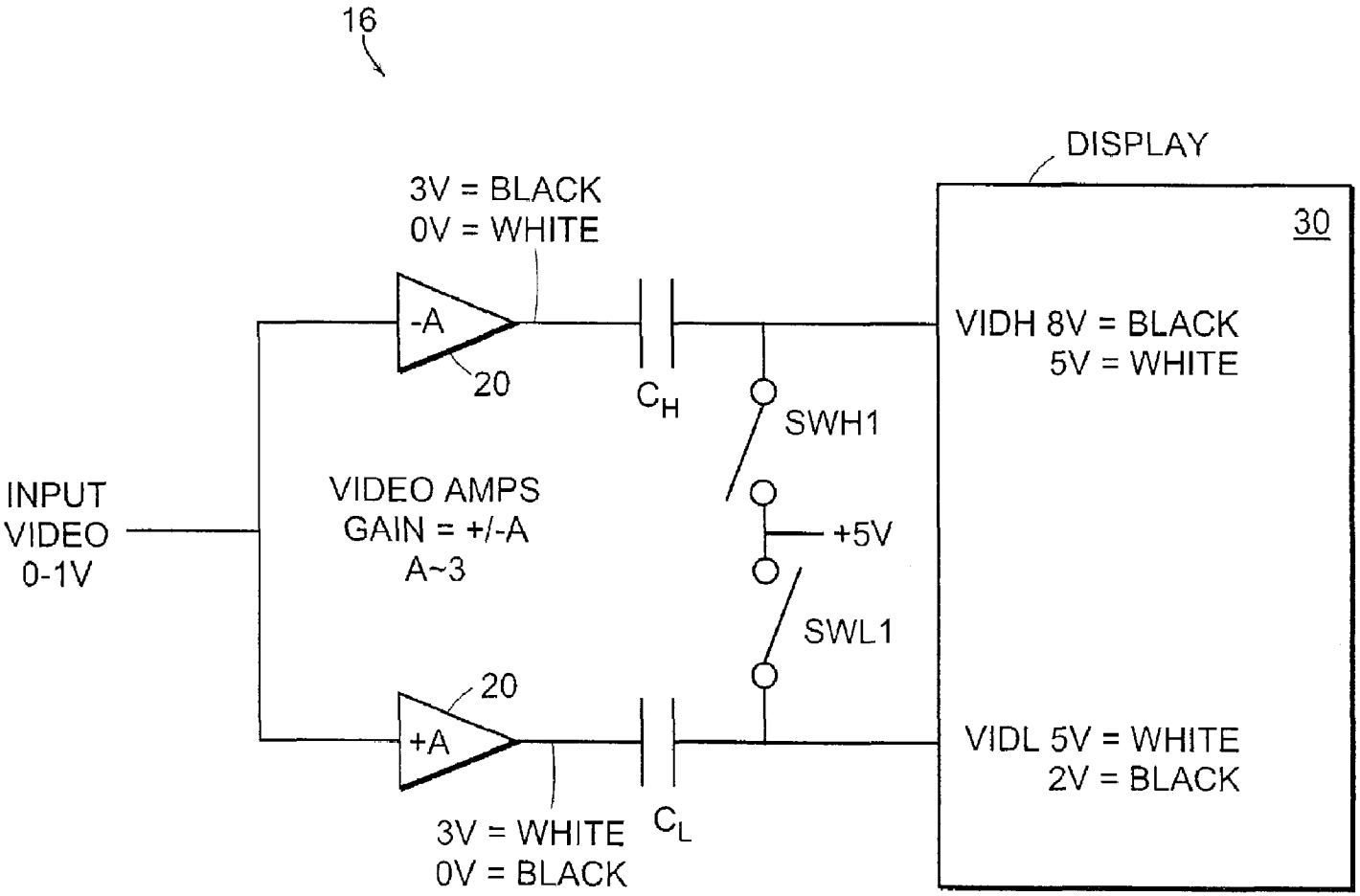
FIG. 6B is a schematic circuit diagram of an AC-coupled driver circuit with two amplifiers, configured for resetting the display to white.

FIG. 6B shows a similar AC-coupled circuit 16, but with both DC restore switches SWH1, SWL1 connected to the 5-volt common level. The offset voltages across $C_H$ and $C_L$ are the same as in FIG. 6A, but in this case, the input signal is driven to white to perform the refresh.

Any convenient level may be used for this DC-restore technique: black, white, gray, or perhaps the sync level. One advantage of resetting to white is that a single +5V reference supply may be used for both switches. However, reset-to-black may be preferred when using standard video signals which already provide a black "blanking period" during horizontal retrace.

Figure 7A:
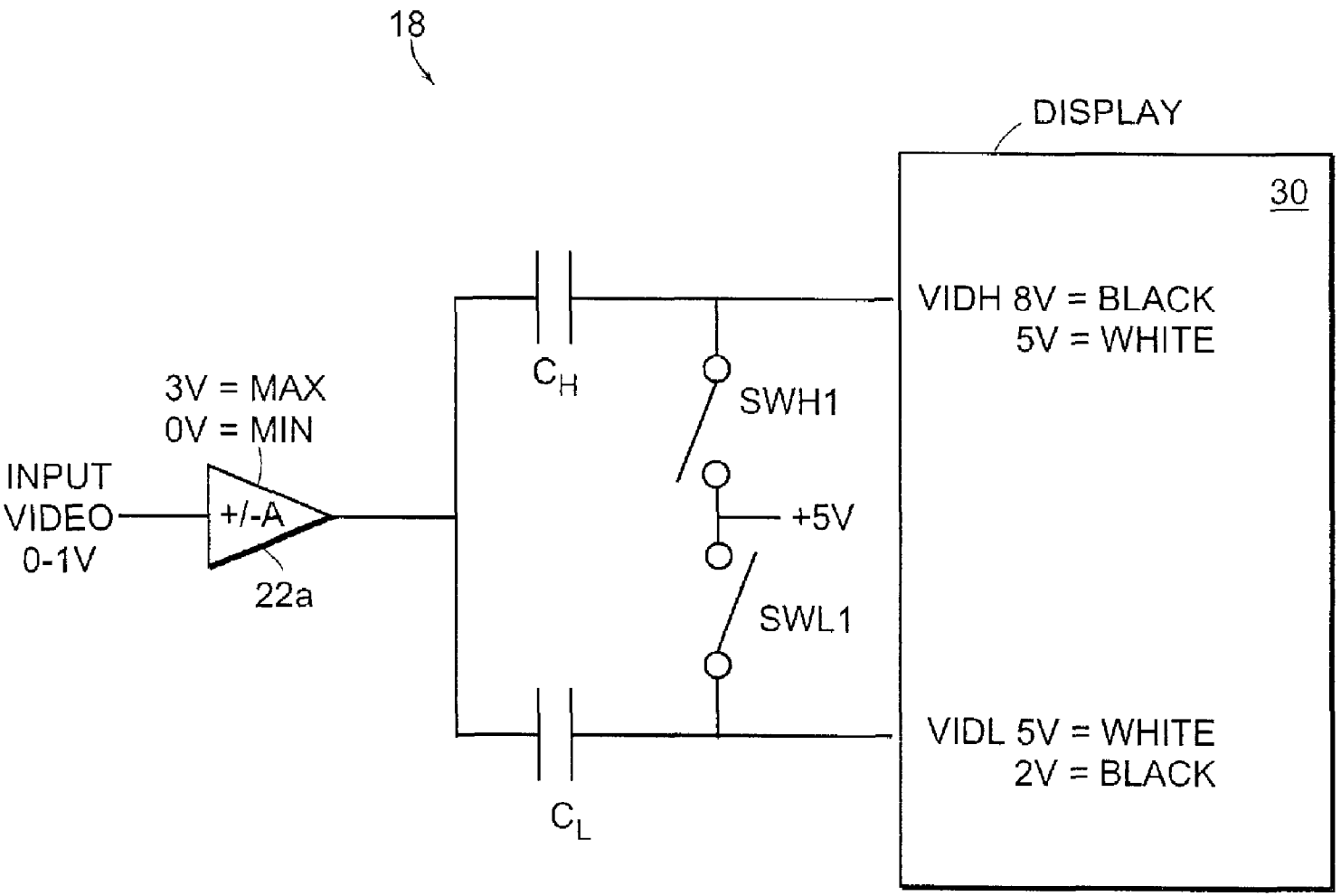
FIG. 7A is a schematic circuit diagram of an AC-coupled driver circuit configured with a single amplifier having switchable gain polarity and with switches restoring DC by resetting to the white level, in accordance with the principles of the present invention.
Figure 7B:
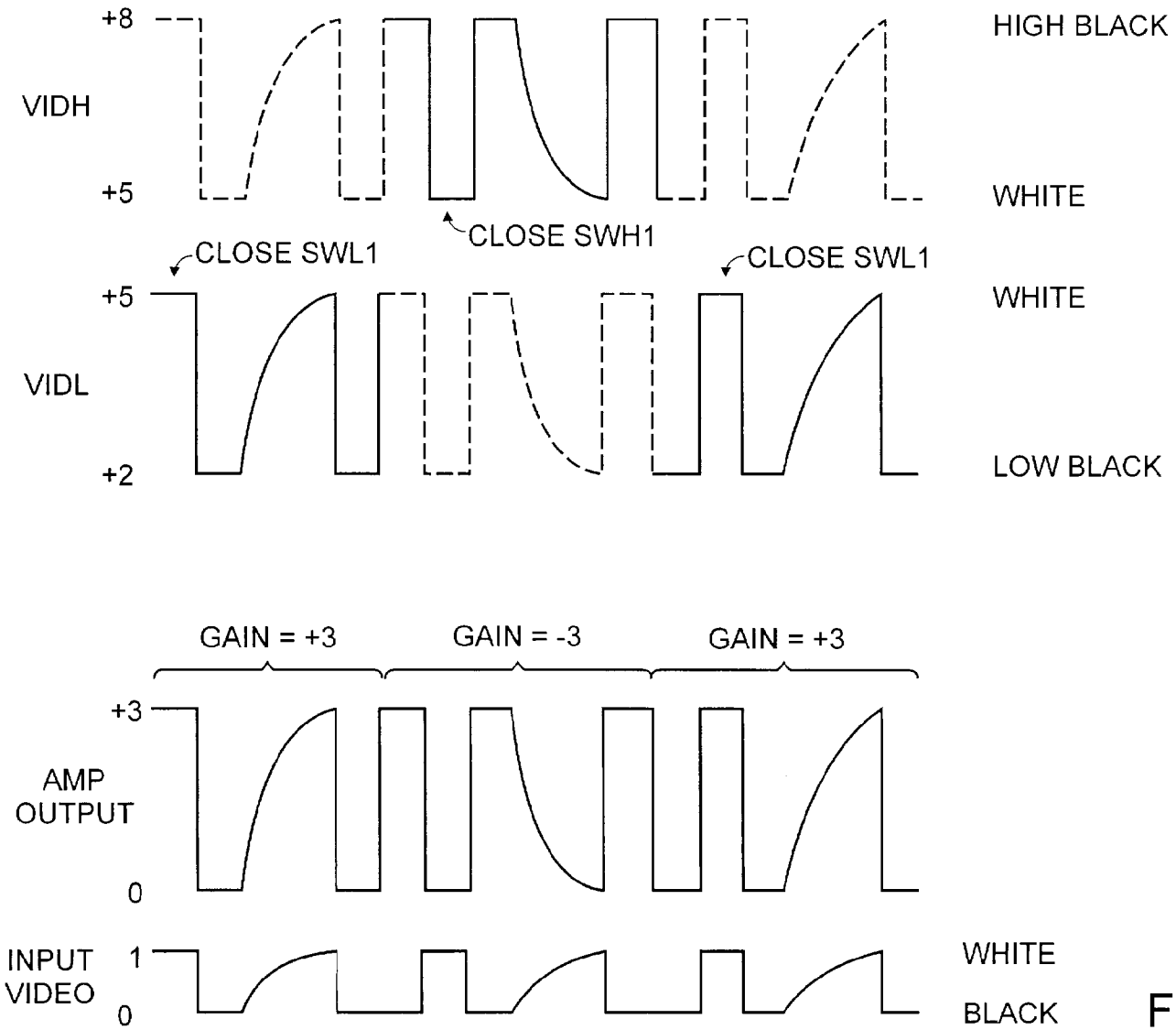
FIG. 7B is a waveform diagram for signals applied in the circuit of FIG. 7A.
Figure 7C:
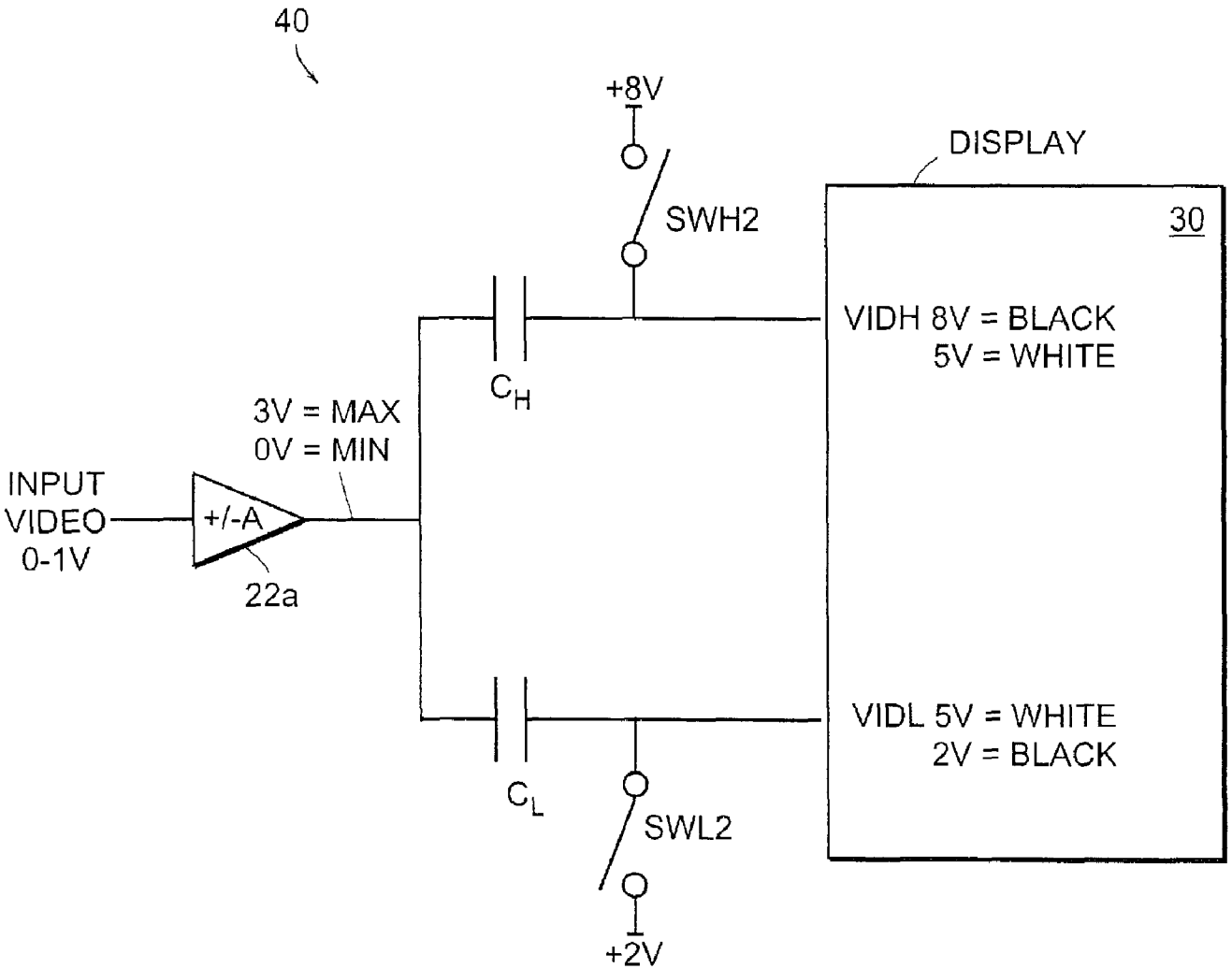
FIG. 7C is a schematic circuit diagram of an AC-coupled driver circuit configured with a single amplifier having switchable gain polarity and with switches restoring DC by resetting to the black levels, in accordance with the principles of the present invention.
Figure 7D:
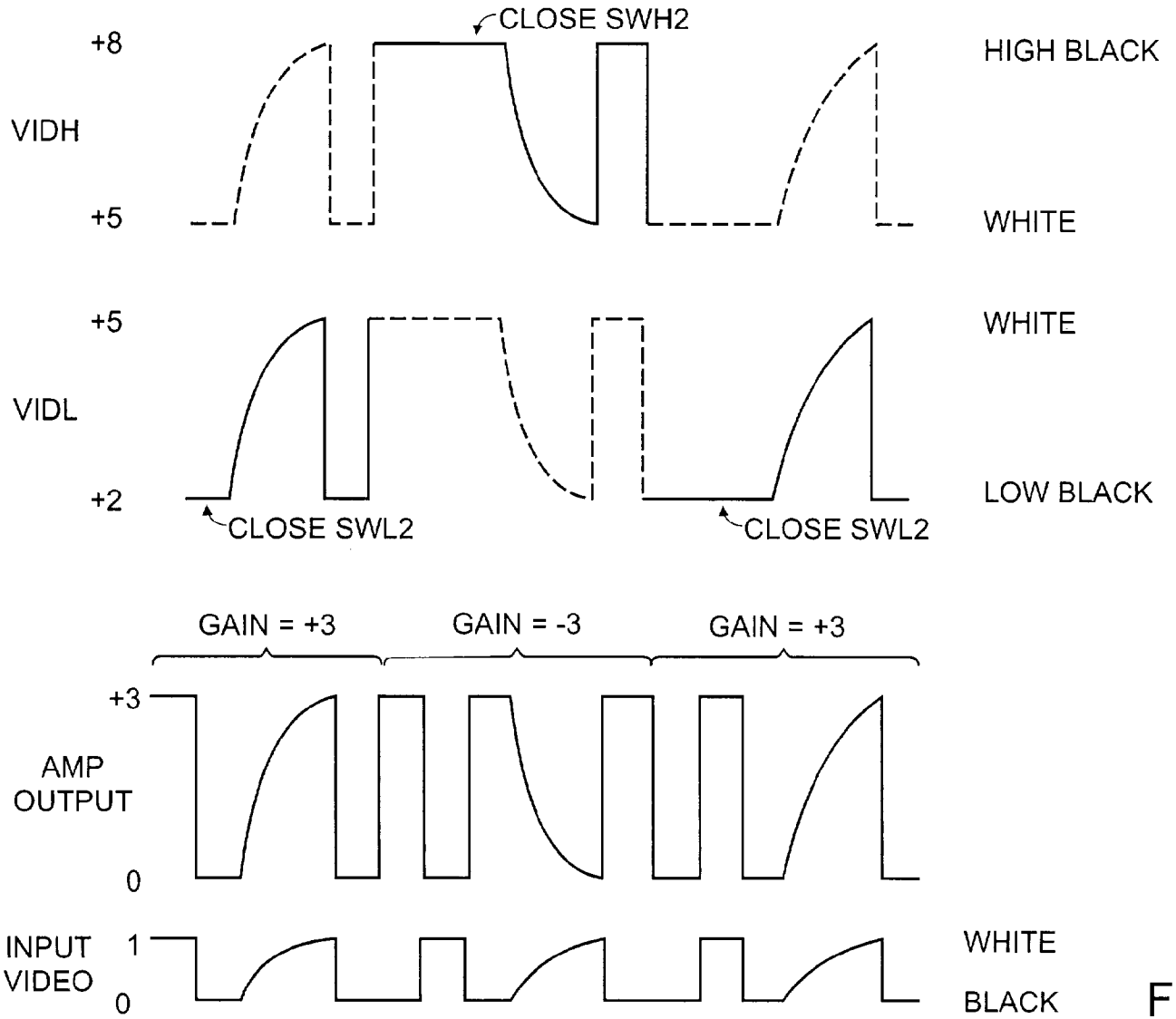
FIG. 7D is a waveform diagram for signals applied in the circuit of FIG. 7C.

As mentioned previously, when row inversion is used then all pixels in a given row have the same polarity, and therefore only a single amplifier is needed. FIGS. 7A and 7C show AC-coupled circuits 18 and 40, respectively, for use with row inversion in accordance with the principles of the present invention. As in the DC-coupled circuit of FIG. 4A, the amplifier polarities in the circuits of FIGS. 7A and 7C are switchable. However, in these AC-coupled embodiments the minimum and maximum signal levels are the same for both polarities. The two switches (SWH1, SWL1 in FIG. 7A; SWH2, SWL2 in FIG. 7C) are operated independently, and the VIDH and VIDL signals are reset at different times. The circuit of FIG. 7A resets to the white level. As shown in the waveform diagram of FIG. 7B, capacitor $C_H$ is reset by closing SWH1 to connect VIDH to +5V while the amplifier output is low (0V), and $C_L$ is reset by closing SWL1 to connect VIDL to +5V while the amplifier output is high (3V). The circuit of FIG. 7C resets to the black levels. As shown in the waveform diagram FIG. 7D, capacitor $C_H$ is reset by closing SWH2 to connect VIDH to +8V while the amplifier output is high (3V), and $C_L$ is reset by closing SWL2 to connect VIDL to +2V while the amplifier output is low (0V).

Figure 8:
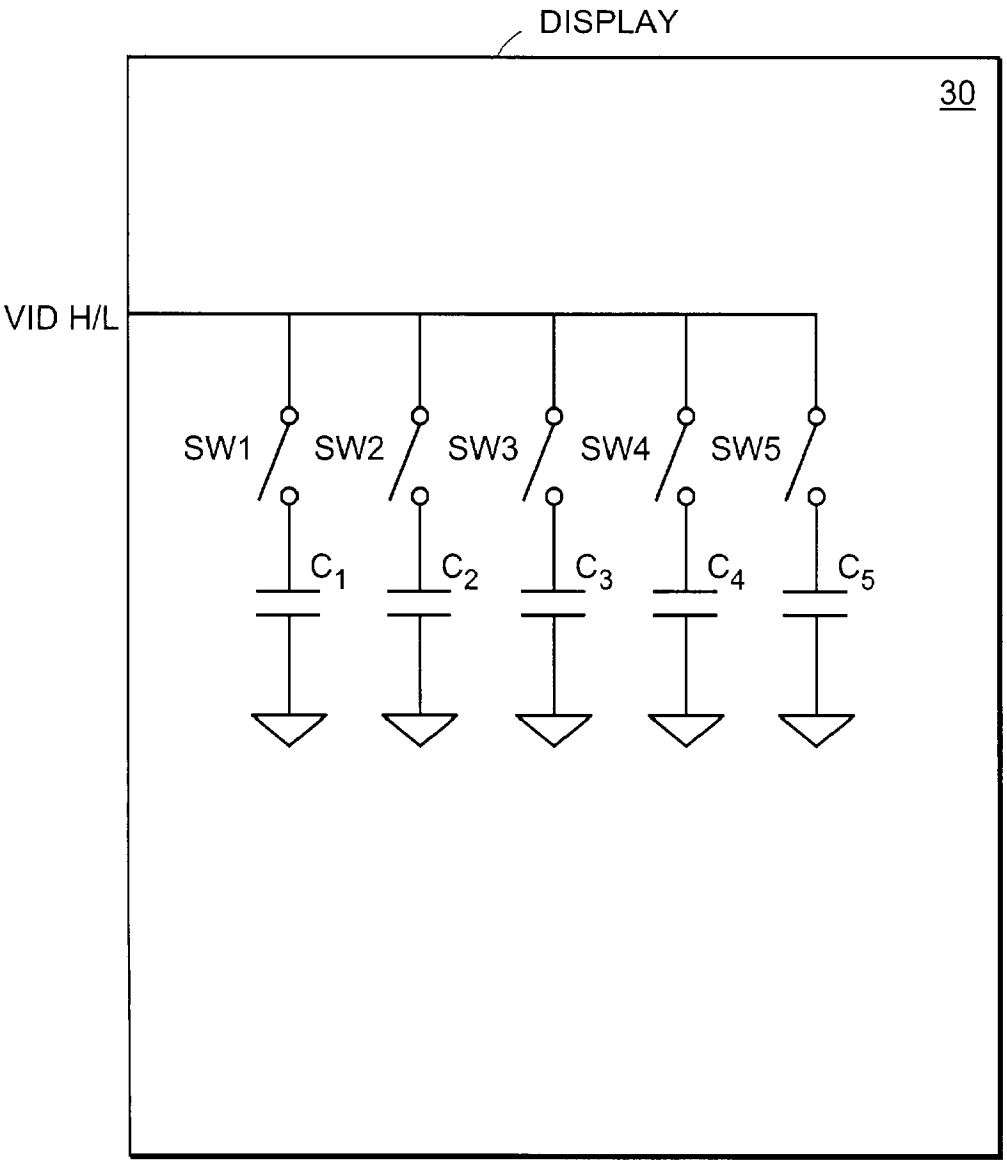
FIG. 8 is a schematic circuit diagram of a display highlighting one row of pixels.
Figure 9:
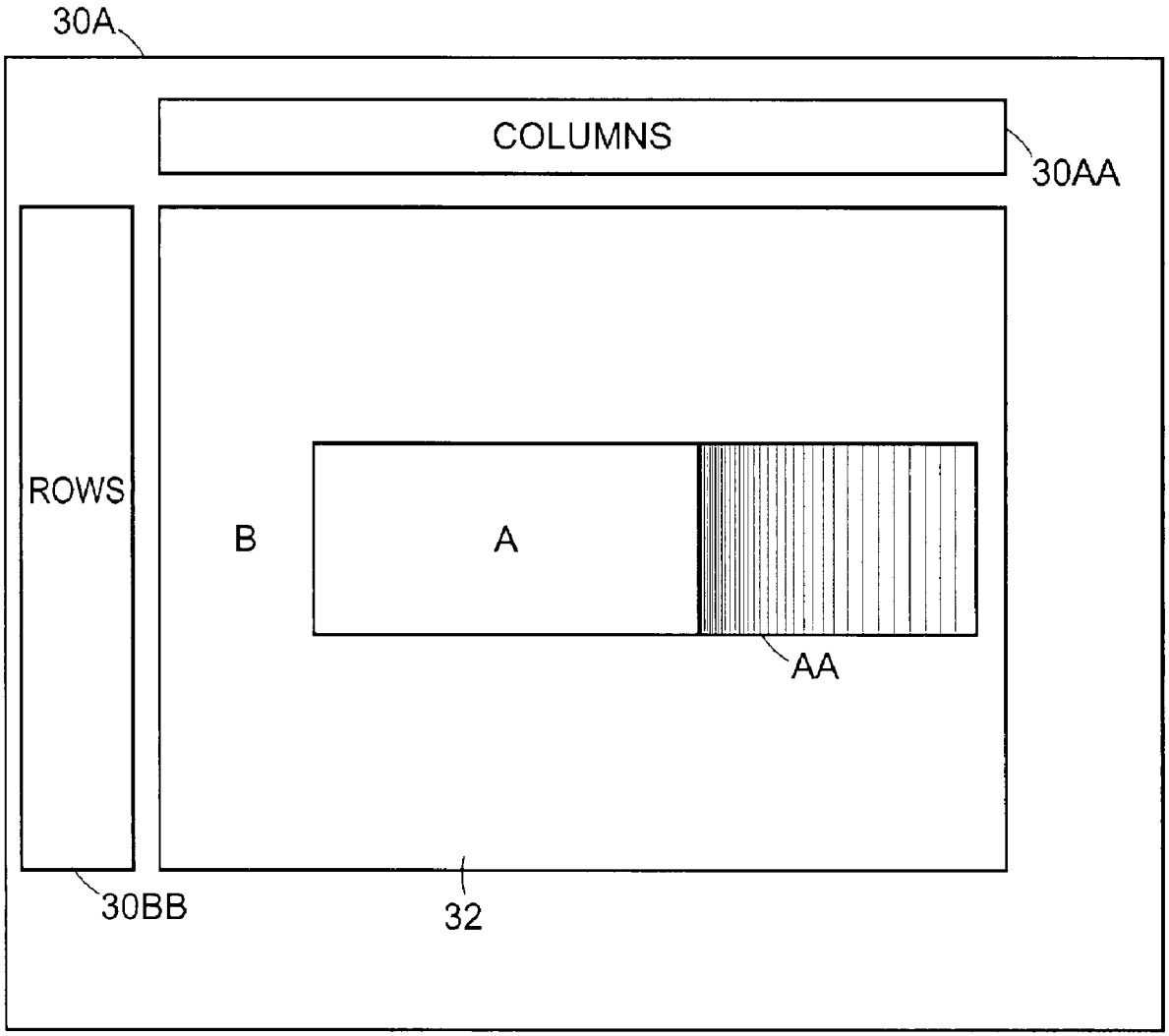
FIG. 9 is a diagram of a display highlighting a bleed through effect.

One problem encountered with AC-coupled drive circuits described in FIGS. 6A, 6B, 7A and 7C is that inputs in the display are not purely high impedance inputs. To illustrate this point, FIG. 8 shows a video line VIDH/L switched through switches SW1–SW5 to several capacitors C1–C5, representing the capacitive loads of all columns driven from that video line. The switches SW1–SW5 represent transmission gates that switch video voltage onto column capacitance. As each transmission gate switch SW1–SW5 is closed, a small charge is transferred from the column capacitance and an error signal accumulates on the external coupling capacitor. The error increases as the scan proceeds further across the display. Therefore, on one side of the image everything is correct but the gray scale values may be different on the opposite side of the image. The magnitude of the error will depend on how much charge was dumped off in the previously scanned portion of the image. This can lead to a horizontal bleeding effect. FIG. 9 illustrates a display 30A that includes an image area 32 having a gray image portion (B) and a black image portion (A). While scanning the black image portion (A), the area (AA) to the right is slightly a different shade of gray than the gray image above it. This is likely because a different charge was transferred onto the capacitors in that area. A solution is to make the capacitors larger so that they can absorb whatever charge is transferred. The same amount of charge on a larger capacitor results in a smaller error signal voltage, thereby preventing this bleeding effect. The AC-coupled drive approaches (FIGS. 6A, 6B, 7A and 7C) permit the use of lower voltage amplifiers, because no signals on the left side of the capacitors exceed 3.3V. However, the DC-restore switches (SWH1, SWL1, SWH2, SWL2) are on the right side of the capacitors, and hence must handle higher voltages.

One might consider integrating the DC-restore switches and video amplifiers on the same chip, but then the chip would require a higher voltage process to implement the switches, and an important advantage of the AC-coupled drive might be lost. A second alternative is to implement the switches externally, with a separate chip, discrete MOSFETs, or similar devices, but this will increase the parts count and hence most probably the cost of the system.

FIGS. 10A–10F show several embodiments of a more desirable approach for AC-coupled drive circuitry in accordance with the present invention. With this approach, one or more DC-restore switches are integrated inside the LCD. Thus, no external IC is needed for the switches, and the amplifiers may be integrated with other components on a low-voltage integrated circuit. In addition, the switches can be implemented in the same high-voltage process used for the display's internal circuits.

Figure 10A:
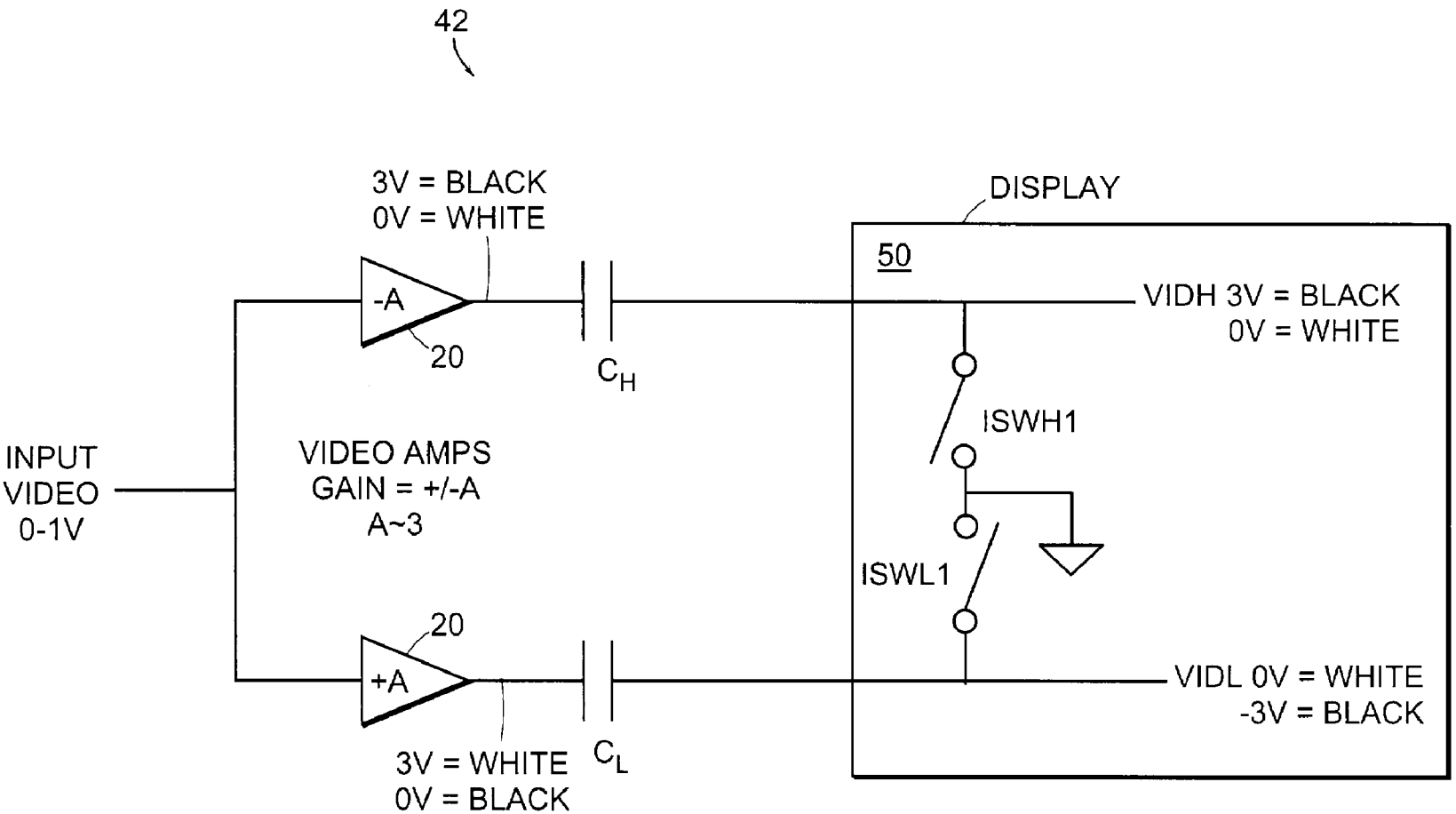
FIG. 10A is a schematic circuit diagram of an AC-coupled display with two integrated switches configured for DC restore while resetting the display to white in accordance with the principles of the present invention.
Figure 10B:
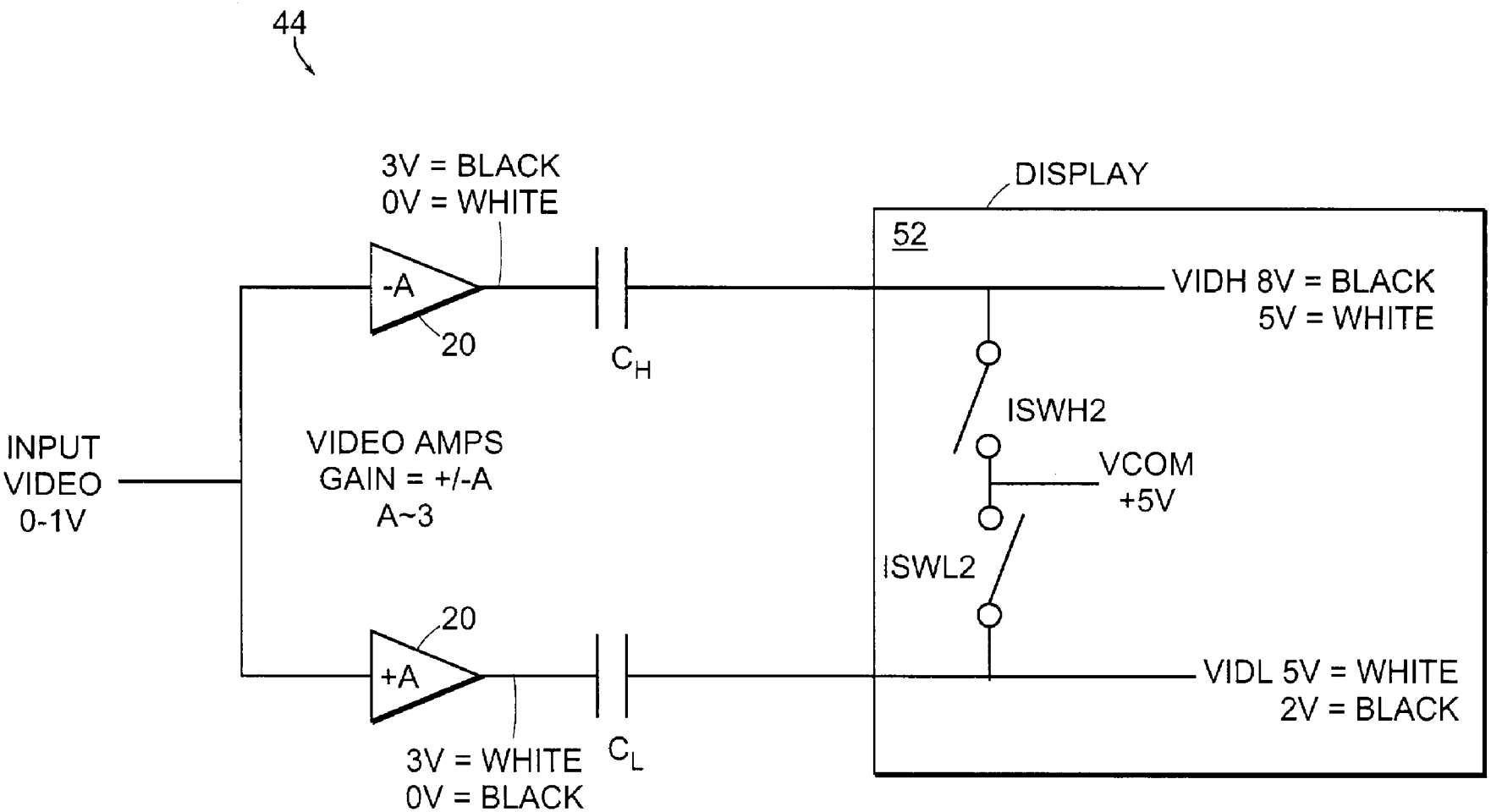
FIG. 10B is a schematic circuit diagram similar to the diagram of FIG. 10A with a 5 volt voltage shift in accordance with the principles of the present invention.
Figure 10C:
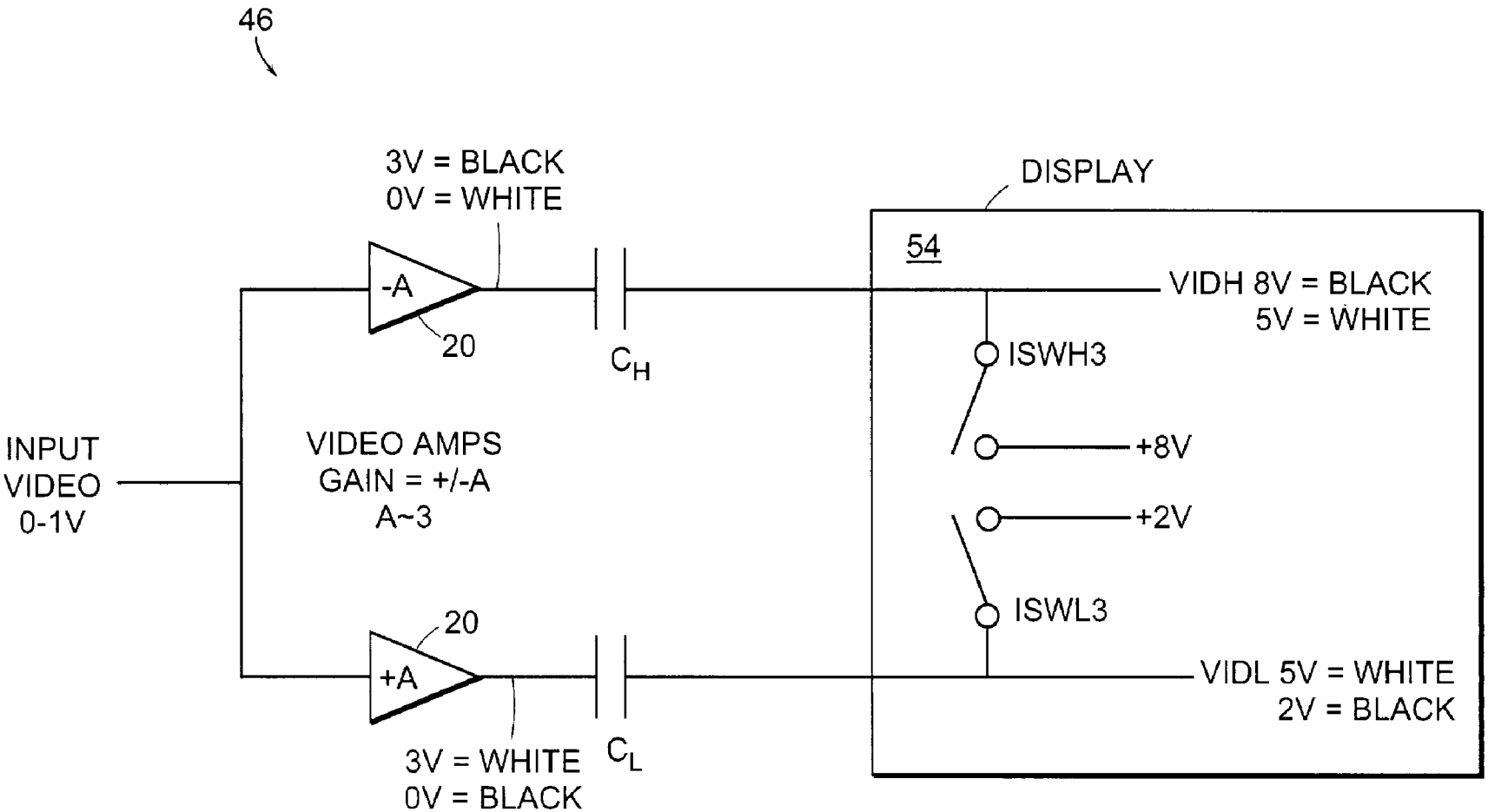
FIG. 10C is a schematic circuit diagram of an AC-coupled display with two integrated switches configured for DC restore while resetting the display to black in accordance with the principles of the present invention.

In particular, FIGS. 10A–10C illustrate embodiments of AC-coupled drive circuits that feature two display inputs and have two integrated switches that are independently operated. FIG. 10A illustrates a circuit 42 that includes a display 50 with integrated switches ISWH1, ISWL1 configured for DC restore while resetting the display to white. FIG. 10B shows a circuit 44 that is similar to the display diagram of FIG. 10A but with integrated switches ISWH2, ISWL2 configured for a 5 volt voltage shift at display 52. The circuit 46 of FIG. 10C includes integrated switches ISWH3, ISWL3 that are configured for DC restore while resetting the display 54 to black.

Figure 10D:
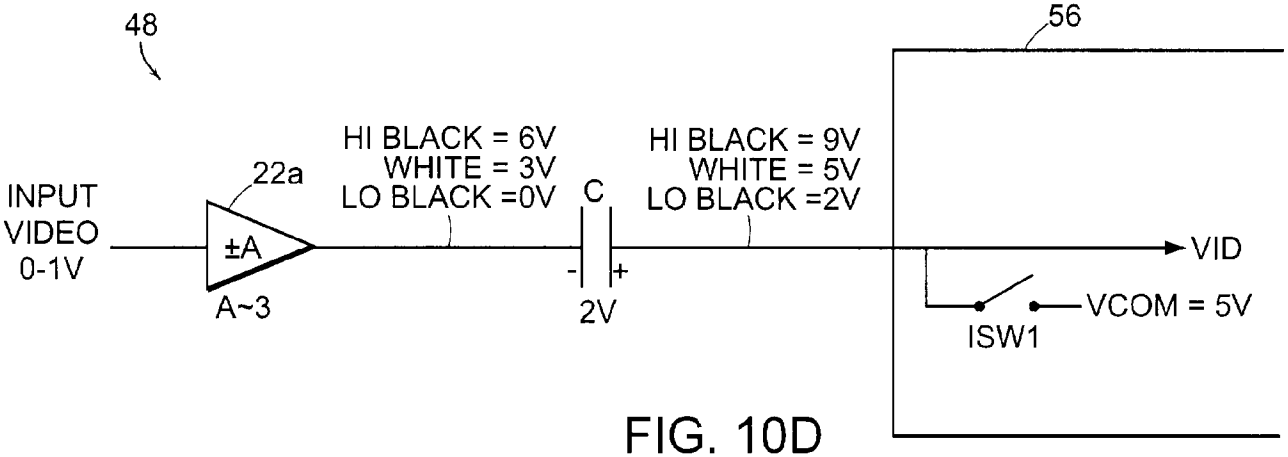
FIG. 10D is a schematic circuit diagram of an AC-coupled display with a single system input, a single display input, and an integrated switch configured for DC restore with display reset to white in accordance with the principles of the present invention.
Figure 10E:
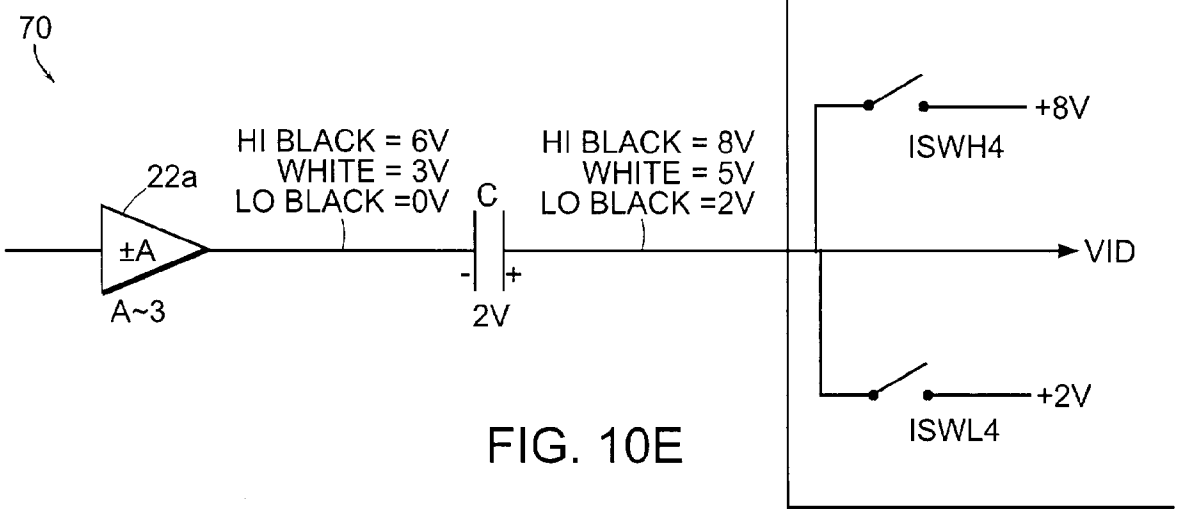
FIG. 10E is a schematic circuit diagram of an AC-coupled display with a single system input, a single display input, and two integrated switches configured for DC restore with display reset to black according to the principles of the present invention.

FIGS. 10D–10E illustrate AC-coupled drive circuits 48, 70 that feature a single system input, a single display input, and integrated switching. The output voltage swing of amplifier 22A is 6V, the same as in the DC-coupled case of FIG. 4A. However, the maximum amplifier output voltage is reduced from 8V in FIG. 4A to 6V in FIGS. 10D and 10E. The reduced output voltage may allow the amplifier 22A to be operated at a lower supply voltage, thereby saving power. The circuit 48 of FIG. 10D has a single integrated switch ISW1 configured for DC restore with display 56 reset to white. The switch ISW1 is closed periodically with the input video at the white level. The circuit 70 of FIG. 10E includes two integrated switches ISWH4, ISWL4 configured for DC restore with display 58 reset to black. One or both of the switches ISWH4 and ISWL4 may be used. The switches are operated independently, with ISWH4 closed when the amplifier output is at the high black level (6V), and/or with ISWL4 closed when the amplifier output is at the low black level (0V). If both switches are used, then the +8V and +2V references should be well matched to the limits of the amplifier output swing.

Figure 10F:
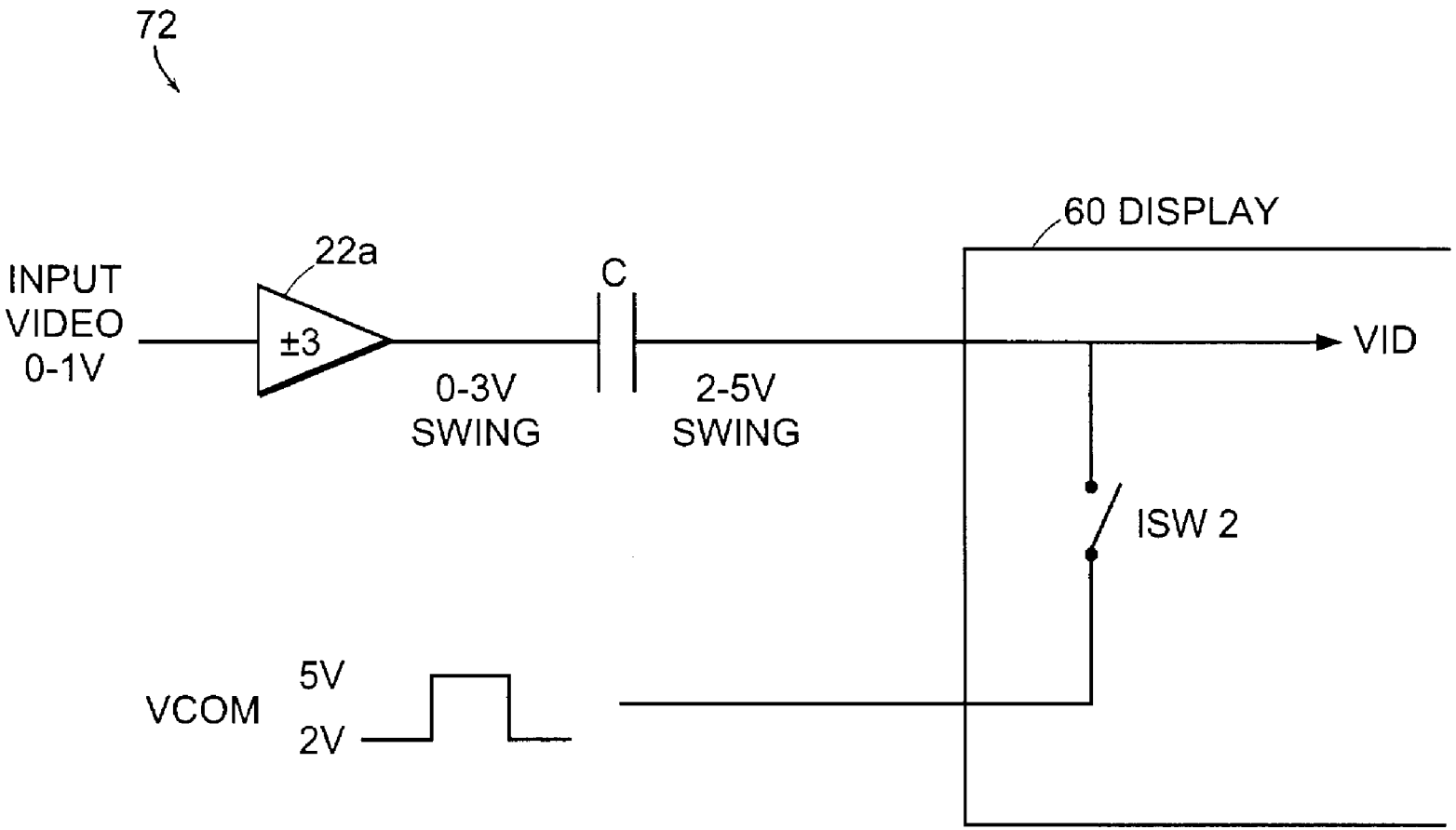
FIG. 10F is a schematic circuit diagram of an AC-coupled display with a single system input, a single display input, and an integrated switch configured for DC restore with display reset to white and AC common in accordance with the principles of the present invention.

FIG. 10F illustrates a display drive circuit 72 with AC-coupled video, an AC-common signal, and integrated switching. The VCOM signal levels are the same as in the DC-coupled case of FIG. 5. The use of AC-coupled video reduces the maximum voltage level required at the amplifier output. DC restore is performed by closing switch ISW2 integrated within display 60 while the input video signal is at the white level (1V).

Figure 10G:
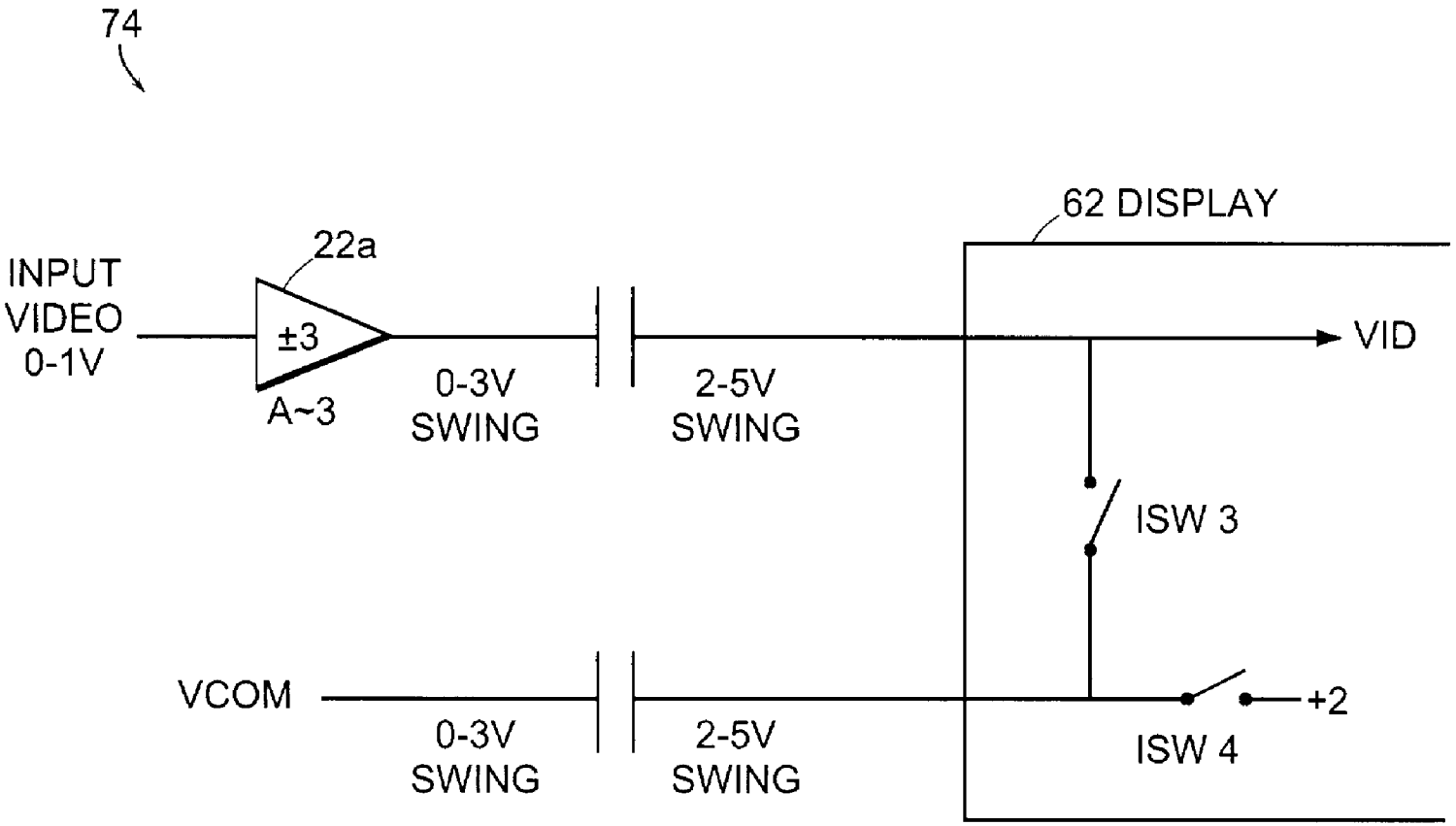
FIG. 10G is a schematic circuit diagram similar to FIG. 10F, using an AC-coupled common signal and integrated common switch, in accordance with the principles of the present invention.

FIG. 10G illustrates a display drive circuit 74 with AC-coupled video, an AC-common signal, and integrated switching for both video and VCOM signals at display 62. The video signal is reset to the white level by closing switch ISW3 and connecting VID to VCOM. The VCOM level is restored by closing ISW4 and connecting VCOM to a (+2V) reference level.

Figure 10H:
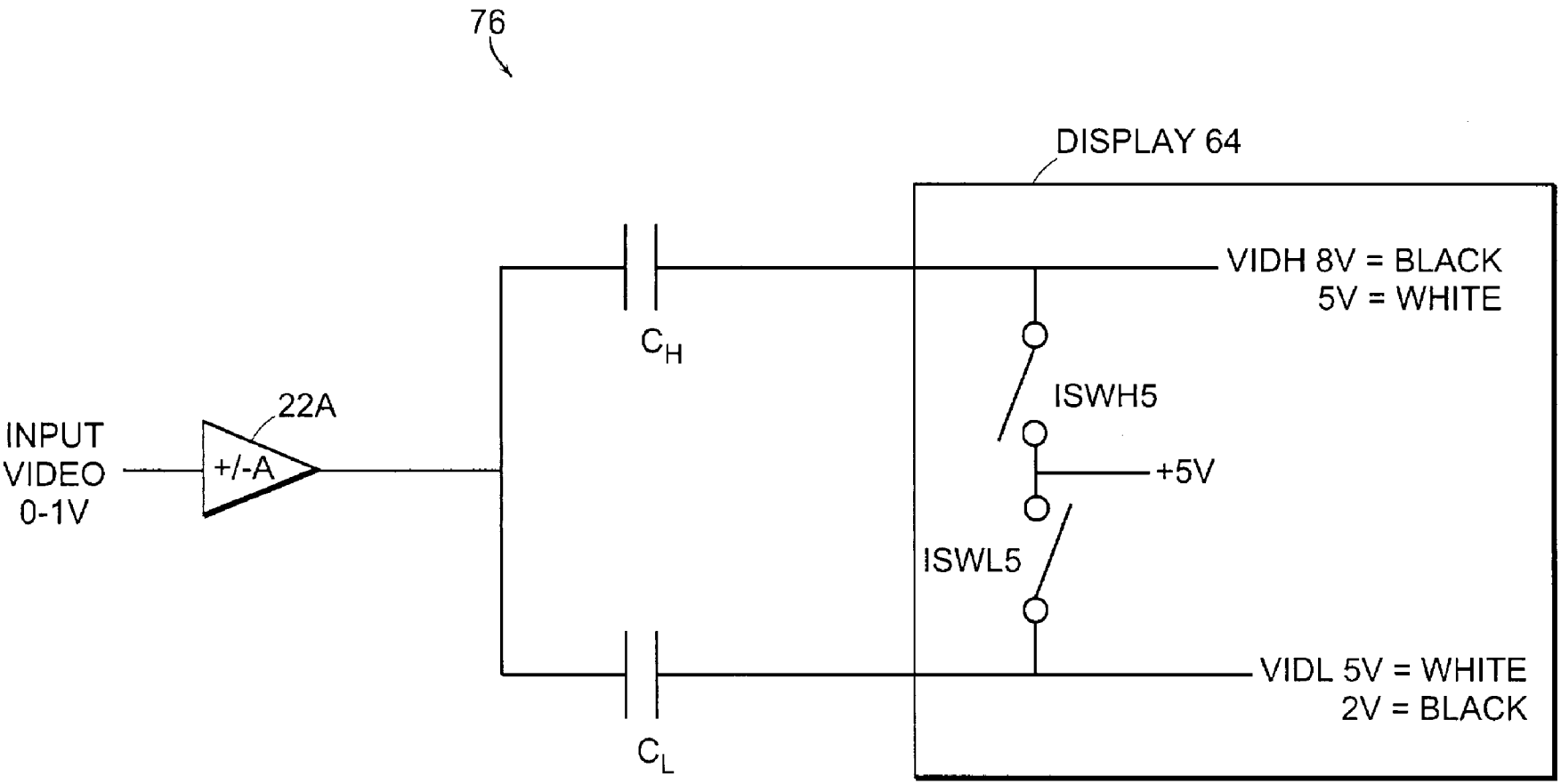
FIG. 10H is a schematic circuit diagram of an AC-coupled driver circuit configured with a single amplifier having switchable gain polarity and with integrated switches restoring DC by resetting to the white level, in accordance with the principles of the present invention.
Figure 10I:
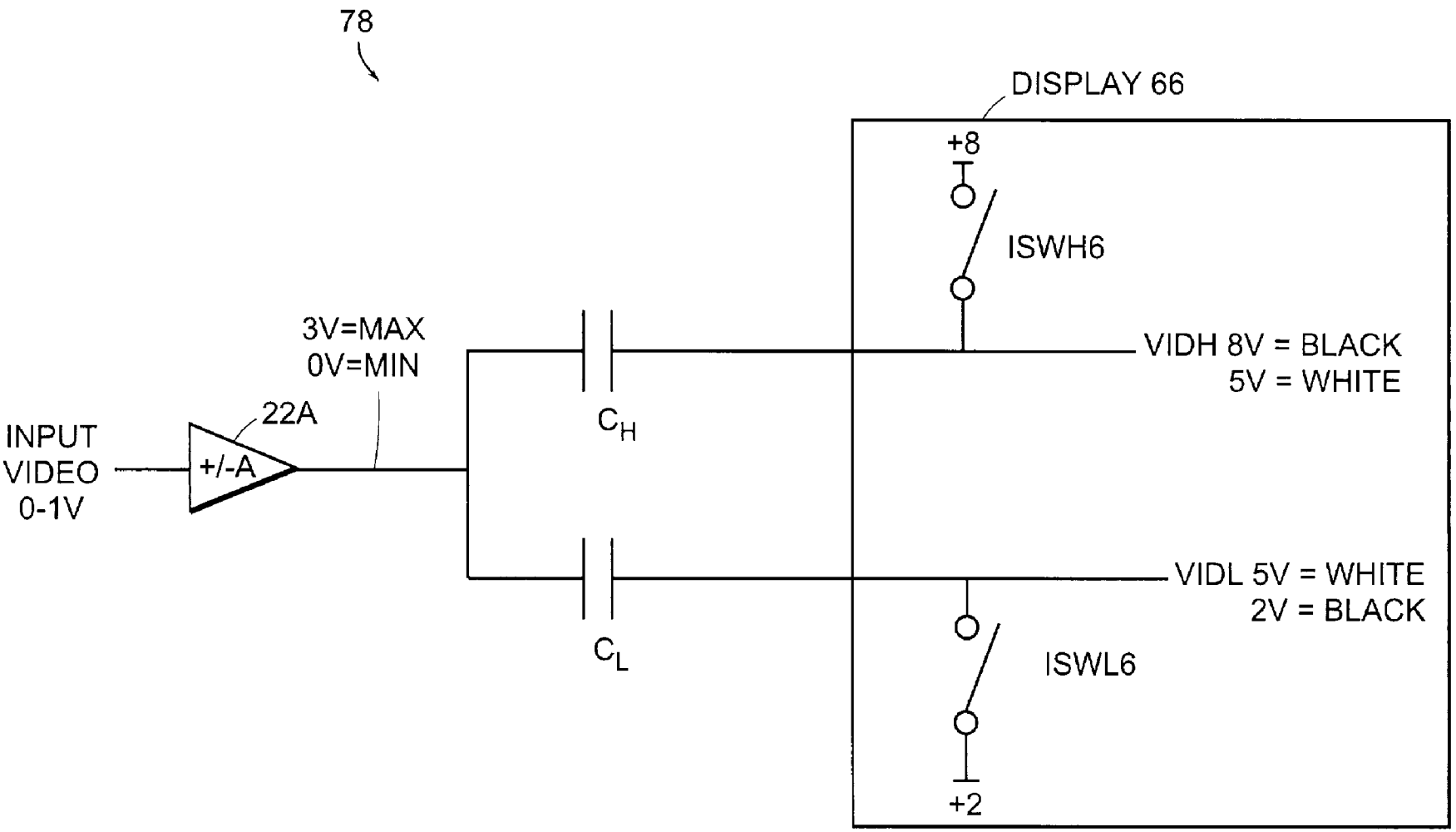
FIG. 10I is a schematic circuit diagram of an AC-coupled driver circuit configured with a single amplifier having switchable gain polarity and with integrated switches restoring DC by resetting to the black levels, in accordance with the principles of the present invention.

Note that the external switches (SWH1, SWL1, SWH2, SWL2) in the AC-coupled drive circuits of FIGS. 7A and 7C can be integrated into the display in accordance with the principles of the present invention, as shown in FIGS. 10H and 10I, respectively. FIG. 10H illustrates display driver circuit 76 with integrated switches ISWH5, ISWL5 at display 64. FIG. 10I illustrates display driver circuit 78 with integrated switches ISWH6, ISWL6 at display 66.

It should be understood that in other embodiments in accordance with the principles of the present invention, there can be configurations in which there are no amplifiers. For example, in bi-level video systems (i.e., black and white, but no gray), the system input may be driven with switches but without an amplifier.

Figure 11A:
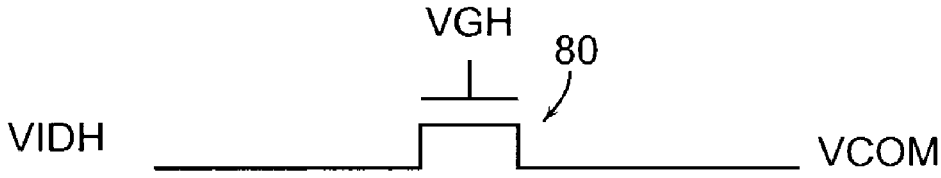
FIG. 11A is a diagram of an NMOS switch for use with a video high display input signal in any of the embodiments of FIGS. 10A–10B.

Operation of the integrated switches for the embodiments of FIGS. 10A–10G will now be described. FIG. 11A is a diagram of an NMOS switch 80 for use with a video high display input signal in any of the embodiments of FIGS. 10A–10B. The diagram of FIG. 11A shows the NMOS switch coupled to display input signal VIDH and common voltage VCOM. In this case, VIDH>=VCOM. The switch is controlled by gate voltage VGH. The NMOS switch is gated off when (VGH−VCOM)<VTN, where VTN (~1–2V) is the threshold voltage, and is therefore gated off when VGH=VCOM. The switch 80 is gated on when (VGH−VCOM)>VTN. To achieve adequate conductance, the switch needs to have VGH−VCOM−VTN=several volts (~1–3V).

Figure 11B:
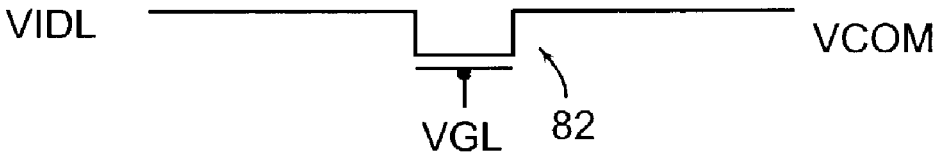
FIG. 11B is a diagram of a PMOS switch for use with a video low display input signal in the embodiments of FIGS. 10A–10B.

Similarly, FIG. 11B is a diagram of a PMOS switch 82 for use with a video low display input signal in the embodiments of FIGS. 10A–10B. The PMOS switch is shown coupled to display input signal VIDL and common voltage VCOM. In this instance, VIDL<=VCOM. The switch 82 is controlled by gate voltage VGL. The PMOS switch is gated off when (VGL−VCOM)>VTP, where VTP (~−1 to −2V) is the threshold voltage, and is therefore gated off when VGL=VCOM. The switch is gated on when (VGL−VCOM−VTP)=several negative volts (~−1 to −3V).

Figure 11C:
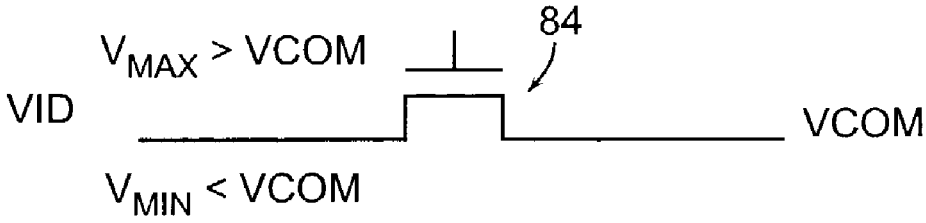
FIG. 11C is a diagram of an NMOS switch for use with a single video display input signal in the embodiments of FIG. 10D or FIG. 10F, in which the video input may is swing above or below VCOM.

FIG. 11C is a diagram of an NMOS switch 84 for use with a single video display input signal in the embodiments of FIG. 10D or FIG. 10F. In this case, the switch is shown coupled to display input VID and common voltage VCOM, with VMAX>VCOM and VMIN<VCOM. The switch 84 is controlled by gate voltage VG. The switch is gated off when VG<VMIN+VTN, which will be less than VCOM+VTN. The switch is gated on when VG>VMAX+VTN.

Figure 11D:
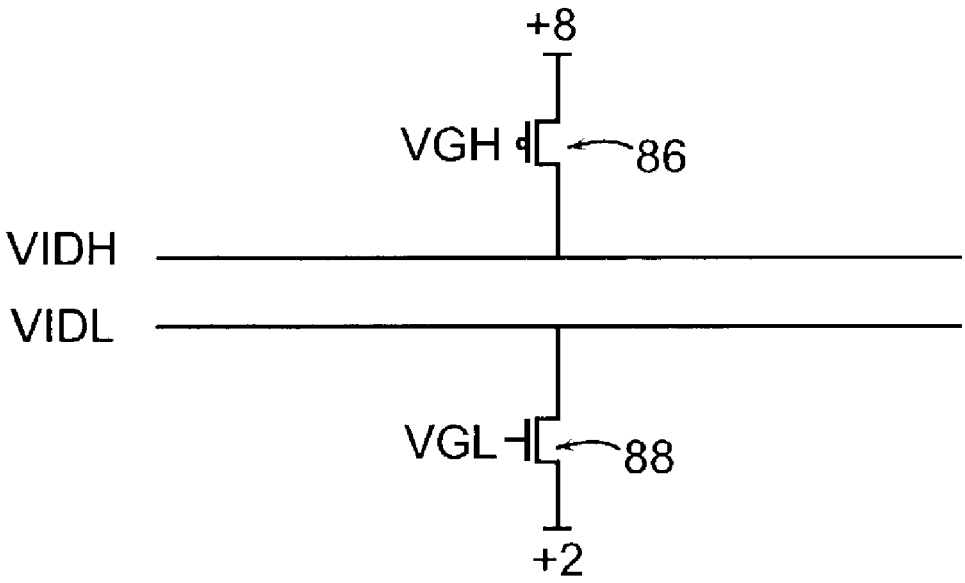
FIG. 11D is a diagram of a pair of NMOS and PMOS switches for use with video high and video low input signals in the embodiment of FIG. 10C.
Figure 11E:
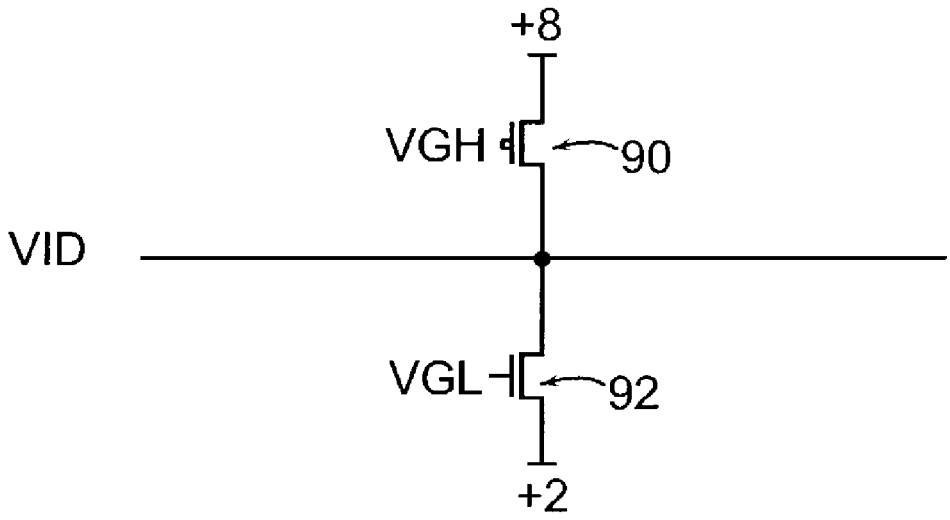
FIG. 11E is a diagram of a pair of NMOS and PMOS switches for use with a video input signals in the embodiment of FIG. 10E.

FIG. 11D is a diagram of a pair of NMOS and PMOS switches 86, 88 for use with video high and video low input signals in the embodiment of FIG. 10C. The NMOS switch 88 is shown coupled to display input VIDL and the low black reference level (+2V), and the PMOS switch 86 is shown coupled to the display input VIDH and the high black reference level (+8V). In this case VIDH is less than the high black reference (+8V), and VIDL is greater than the low black reference level (+2V). The PMOS switch is controlled by gate voltage VGH, and the NMOS switch is controlled by gate voltage VGL. FIG. 11E is similar to FIG. 11D with switches 90, 92, but with a single video input as in the embodiment of FIG. 10E.

It is noted that for single display input embodiments, there needs to be more voltage swing on VG than for the voltage swing on VGH. VGL in case of two display input embodiments. However, in either case, it is desirable in general to have a greater voltage swing available on VG, VGH, and VGL. It is generally known that for MOS circuits, the current ~(W/L)(VGS−VT) in the linear region of operation, where VGS is the gate voltage and W and L are the width and length of the channel. Thus, by increasing VGS, a smaller FET can be used, thereby reducing size, power and cost. To provide for greater voltage swing at the gate voltage, a bootstrapping circuit approach can be implemented for the embodiments of FIGS. 10A–10G that include integrated switches.

Figure 12A:
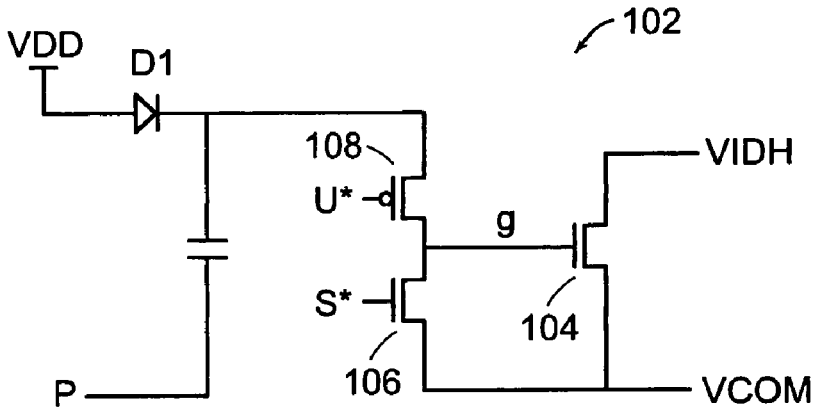
FIG. 12A is a schematic circuit diagram of a bootstrapping circuit for use with the embodiments of FIGS. 10A–10B.
Figure 12B:
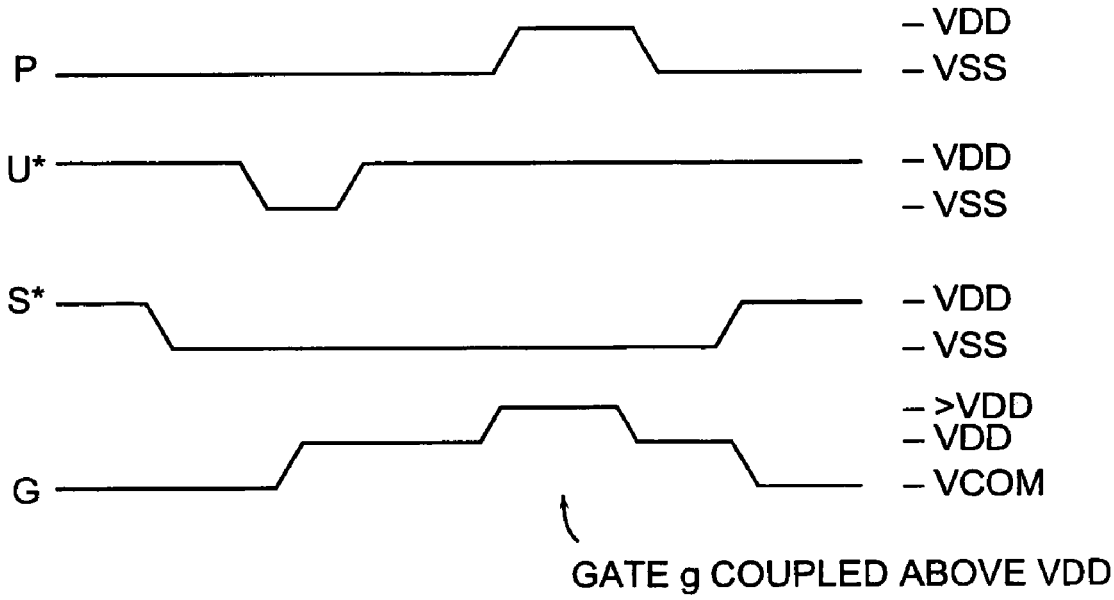
FIG. 12B is a waveform diagram of control signals for the bootstrapping circuit of FIG. 12A.
Figure 13A:
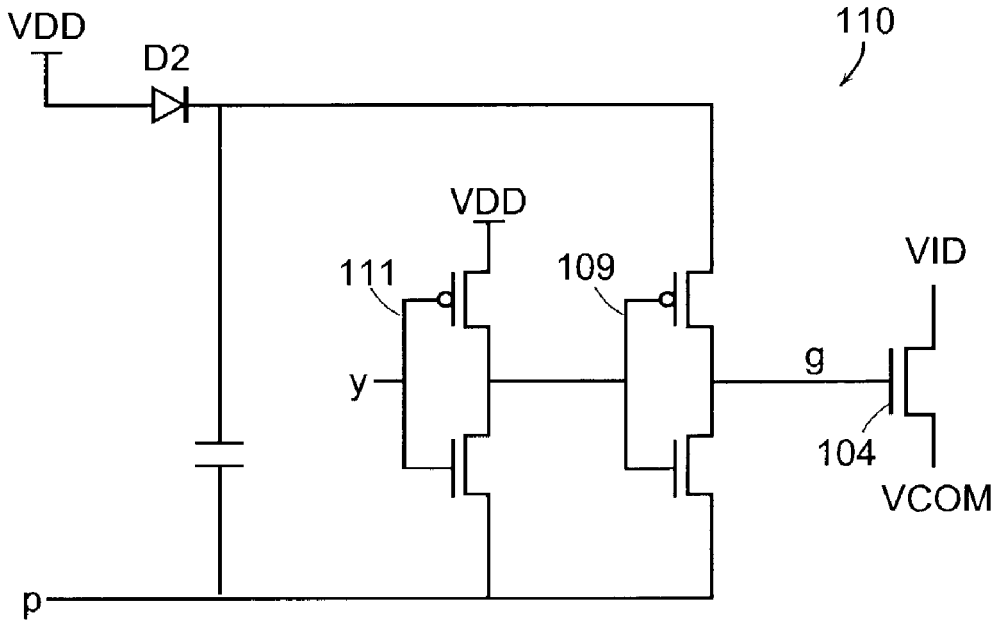
FIG. 13A is a schematic circuit diagram of a bootstrapping circuit for use with the embodiments of FIG. 10D or FIG. 10F.
Figure 13B:
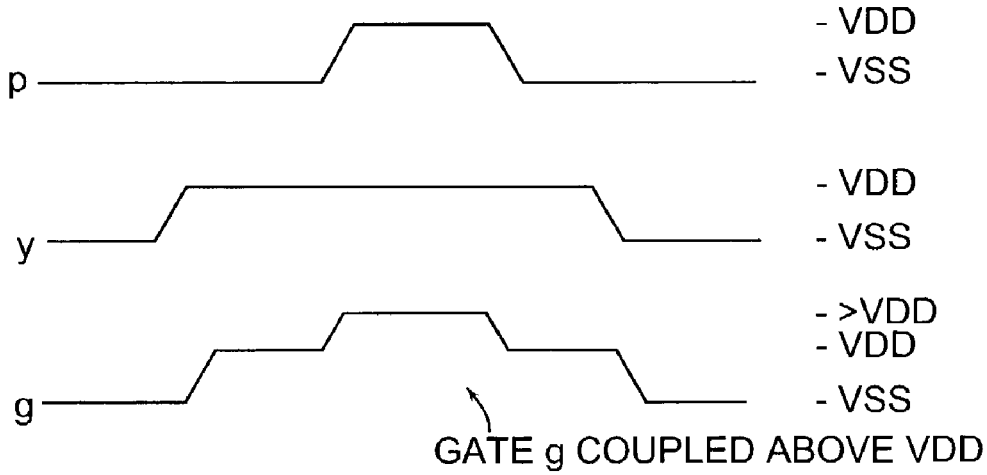
FIG. 13B is a waveform diagram of control signals for the bootstrapping circuit of FIG. 13A.

FIG. 12A is a schematic circuit diagram of a bootstrapping circuit 102 for use with the embodiments of FIGS. 10A–10B. FIG. 12B is a waveform diagram of control signals for the bootstrapping circuit of FIG. 12A. FIG. 13A is a schematic circuit diagram of a bootstrapping circuit 110 for use with the embodiments of FIG. 10D or FIG. 10F. FIG. 13B is a waveform diagram of control signals for the bootstrapping circuit of FIG. 13A.

The bootstrapping circuit 102 (FIG. 12A) includes switches 104, 106, 108. The timing diagram of FIG. 12B begins with gate voltage g held at the VCOM level, and the NMOS switch therefore open. Signal s* is then driven low to disconnect g from VCOM. Signal u* is then pulsed low, pulling gate Voltage g up toward VDD through diode D1. When signal p is then pulsed high, gate voltage g is capacitively coupled to a voltage higher than VDD, thereby increasing the switch conductance. The dual of circuit FIG. 12A may be used to drive a PMOS switch.

The circuit 110 of FIG. 13A performs a bootstrap function similar to that of FIG. 12A, while also allowing the gate voltage g to be driven below VCOM, as is required for the embodiments of FIG. 10D or FIG. 10F. Node g is driven by two inverters 109, 111 which have their negative supplies connected to signal p. Signal y is an un-boosted input signal. The circuit configuration ensures that no transistor's drain-to-source voltage $V_{DS}$ exceeds (VDD−VSS), which may avoid transistor breakdown and improve circuit reliability.

Figure 14:
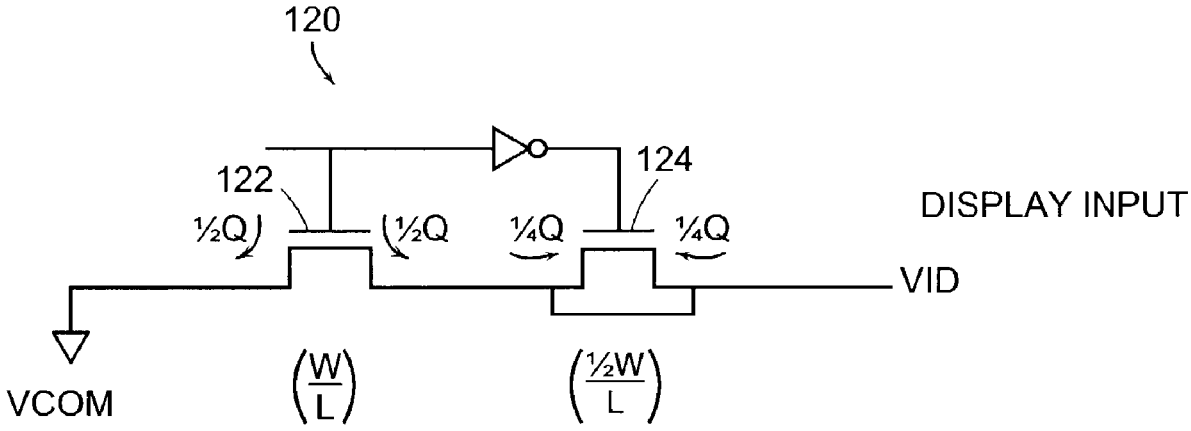
FIG. 14 is a schematic diagram of a charge injection cancellation circuit for use with the integrated switches of the embodiments of FIGS. 10A–10F.

FIG. 14 is a schematic diagram of a charge injection cancellation circuit 120 for use with the integrated switches of the embodiments of FIGS. 10A–10G. When switch transistor 122 of size (W/L) turns off, its channel charge is injected onto the source and drain nodes VCOM and VID. Assuming that each node receives half of the charge, the charge may be cancelled by a compensation transistor 124 of size ((W/2)/L). The gate of the cancellation circuit is driven by the inverse signal of the switch gate, so that the cancellation FET turns on soon after the switch transistor turns off.

Figure 15:
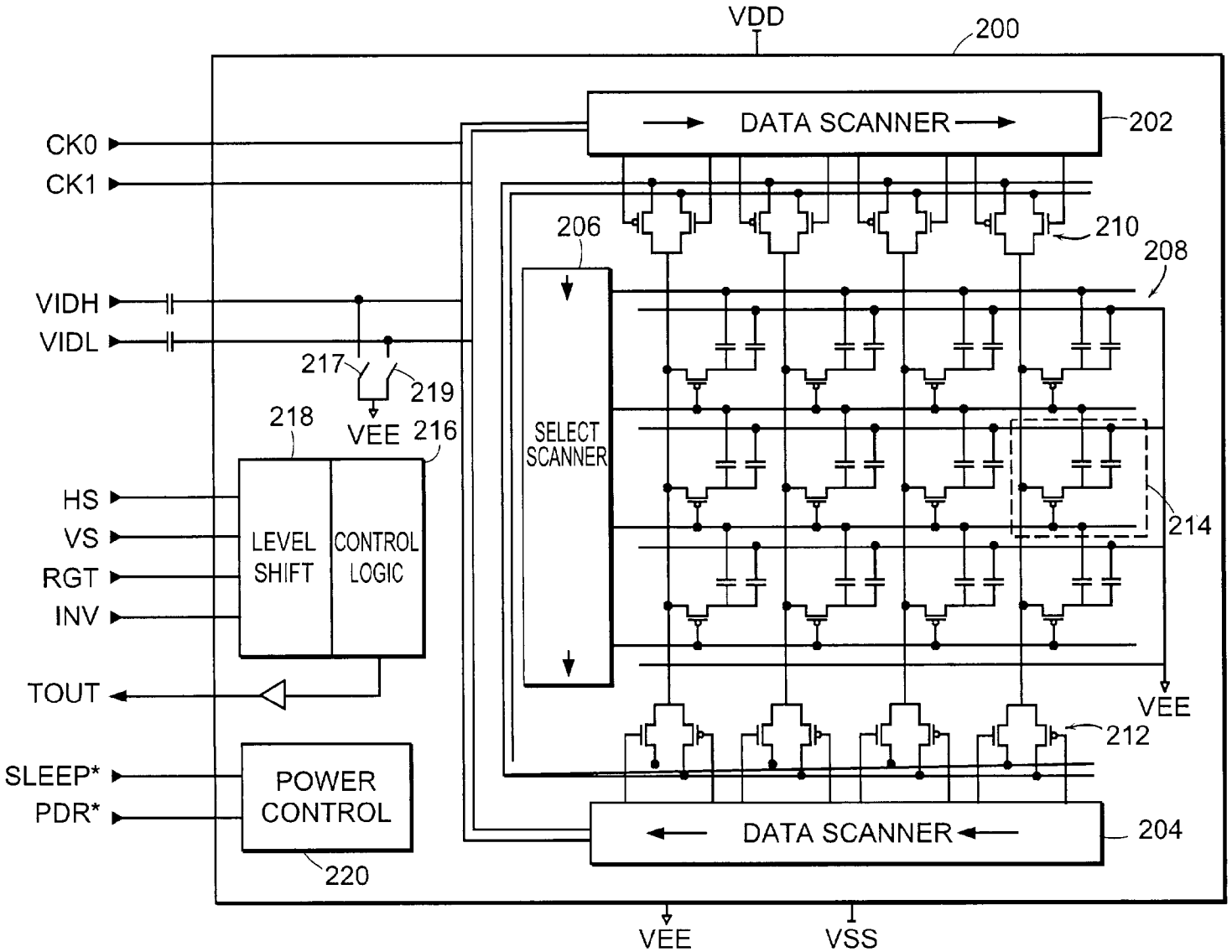
FIG. 15 is a schematic circuit diagram of an integrated circuit active matrix display for use in embodiments according to the present invention.

An embodiment of an integrated circuit active matrix display 200 is shown schematically in FIG. 15. The circuit 200 includes data scanners 202 and 204, select scanner 206, active matrix pixel array 208, a plurality of transmission gates 210 and 212, control logic 216, integrated switches 217 and 219, level shift 218, and power control 220.

The integrated scanners drive the active matrix pixel array 208. The pixel array 208 has a plurality of pixel elements 214. The RGT input selects one of the two data scanners for left-to-right (202) or right-to-left (204) horizontal scanning. The select scanner 206 scans vertically from top to bottom. The data scanners 202, 204 accept logic-level clock inputs directly from the input pads, thereby reducing the power dissipation and skew otherwise associated with internal clock drivers. Complementary video signals are accepted on the AC-coupled VIDH and VIDL inputs, with internal switches 217 and 219, respectively, restoring DC levels during the horizontal retrace interval. The VIDH and VIDL signals carry video signals to the transmission gates 210 and 212.

While this invention has been particularly shown and described with references to preferred embodiments thereof, it will be understood by those skilled in the art that various changes in form and details may be made therein without departing from the scope of the invention encompassed by the appended claims.

What is claimed is:

1. A liquid crystal display system comprising:

a system input video signal;

a first amplifier having a first gain for amplifying the system input video signal to provide a first display input video signal at an output;

a first coupling capacitor coupled at one end to the first amplifier output, the first coupling capacitor providing a first DC level offset to the first display input video signal;

a liquid crystal display panel having a first video input coupled to another end of the first coupling capacitor to receive the first display input video signal for driving the display panel, the panel including a first switch integrated therein and coupled to the first video input that provides DC restore to the first coupling capacitor.

2. The system of claim 1 wherein the first integrated switch provides DC restore to the first coupling capacitor when operated during a retrace interval of the system input video signal.

3. The system of claim 1 further comprising:

a second amplifier having a second gain for amplifying the system input video signal to provide a second display input video signal, the second gain opposite in polarity to the first gain such that the second display input video signal is a complement of the first display input video signal;

a second coupling capacitor coupled at one end to the second amplifier output, the second coupling capacitor providing a second DC level offset to the second display input video signal;

wherein the liquid crystal display panel includes a second video input coupled to another end of the second coupling capacitor to receive the second display input video signal for driving the display panel, the display panel including a second switch integrated therein and coupled to the second video input that provides DC restore to the second coupling capacitor.

4. The system of claim 3 wherein the first and second integrated switches provide DC restore to the first and second coupling capacitors, respectively, when operated during a retrace interval of the system input video signal.

5. The system of claim 1 wherein frames of the system input video signal employ any of column inversion, row inversion, pixel inversion, and frame inversion.

6. A liquid crystal display system comprising:

a system input video signal;

an amplifier having switchable gain polarity coupled to the system input video signal to provide an amplified system input video signal at an output;

a first coupling capacitor coupled at one end to the amplifier output to provide a first display input video signal having a first DC level offset;

a second coupling capacitor coupled at one end to the amplifier output to provide a second display input video signal having a second DC level offset;

a liquid crystal display device having a first video input coupled to another end of the first coupling capacitor to receive the first display input video signal and a second video input coupled to another end of the second coupling capacitor to receive the second display input video signal for driving the display device;

a first switch that provides DC restore to the first coupling capacitor; and a second switch that provides DC restore to the second coupling capacitor.

7. The system of claim 6 wherein the first and second switches are external to the display device.

8. The system of claim 6 wherein the first and second switches are integrated into the display device.

9. The system of claim 6 wherein the first and second switches provide DC restore to the first and second coupling capacitors, respectively, when operated during a retrace interval of the system input video signal.

10. A liquid crystal display system comprising:

a system input video signal;

a first coupling capacitor coupled at one end to the system input video signal, the first coupling capacitor providing a first display input video signal having a first DC level offset;

a liquid crystal display panel having a first video input coupled to another end of the first coupling capacitor to receive the first display input video signal for driving the display panel, the display panel including a first switch integrated therein and coupled to the first video input that provides DC restore to the first coupling capacitor.

11. The system of claim 10 wherein the first integrated switch provides DC restore to the first coupling capacitor when operated during a retrace interval of the system input video signal.

12. The system of claim 10 further comprising:

a second coupling capacitor coupled at one end to the system input video signal, the second coupling capacitor providing a second display input video signal having a second DC level offset;

wherein the liquid crystal display panel includes a second video input coupled to another end of the second coupling capacitor to receive the second display input video signal for driving the display panel, the display panel including a second switch integrated therein and coupled to the second video input that provides DC restore to the second coupling capacitor.

13. The system of claim 12 wherein the first and second integrated switches provide DC restore to the first and second coupling capacitors, respectively, when operated during a retrace interval of the system input video signal.

14. A liquid crystal display system comprising:

a system input video signal;

amplifier means having switchable gain polarity coupled to the system input video signal to provide an amplified system input video signal;

first AC-coupling means coupled at one end to the amplifier output to provide a first display input video signal having a first DC level offset;

second AC-coupling means coupled at one end to the amplifier output to provide a second display input video signal having a second DC level offset;

liquid crystal display means having a first video input coupled to another end of the first AC-coupling means to receive the first display input video signal and a second video input coupled to another end of the second AC-coupling means to receive the second display input video signal for driving the display device;

first switch means providing DC restore to the first AC-coupling means; and second switch means providing DC restore to the second AC-coupling means.

15. A liquid crystal display system comprising:

AC-coupling means for coupling a display input video signal having a DC level offset;

display panel means having a video input coupled to the AC-coupling means to receive the display input video signal for driving the display panel, the display panel means including switch means integrated therein and coupled to the video input that provides DC restore to the AC-coupling means.

16. A method of driving a liquid crystal panel, the method comprising:

coupling a system input video signal to one end of a coupling capacitor, the coupling capacitor providing a display input video signal having a DC level offset;

coupling a liquid crystal display panel to another end of the coupling capacitor to receive the display input video signal for driving the display panel;

operating a switch integrated within the display panel and coupled to the display input video signal to provide DC restore to the coupling capacitor during a retrace interval of the system input video signal.

17. A liquid crystal display device comprising:

a video input for receiving an AC-coupled video signal that drives the display panel; and an integrated switch in the display panel that provides DC-restore to the AC-coupled video signal during a retrace interval.

18. The device of claim 17 further comprising:

a second video input for receiving a second AC-coupled video signal that is a complement of the first AC-coupled video signal; and a second integrated switch in the display panel that provides DC-restore to the second AC-coupled video signal.

* * * * *